US009908329B2

(12) United States Patent
Yamada

(10) Patent No.: US 9,908,329 B2
(45) Date of Patent: Mar. 6, 2018

(54) LIQUID EJECTING APPARATUS AND DRIVE CIRCUIT

(71) Applicant: SEIKO EPSON CORPORATION, Tokyo (JP)

(72) Inventor: Tomokazu Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/418,906

(22) Filed: Jan. 30, 2017

(65) Prior Publication Data

US 2017/0246864 A1 Aug. 31, 2017

(30) Foreign Application Priority Data

Feb. 26, 2016 (JP) ..... 2016-034999

(51) Int. Cl.
*B41J 2/165* (2006.01)
*B41J 2/045* (2006.01)

(52) U.S. Cl.
CPC ..... *B41J 2/04573* (2013.01); *B41J 2/04541* (2013.01); *B41J 2/04581* (2013.01); *B41J 2/04588* (2013.01); *B41J 2/04593* (2013.01); *B41J 2/04596* (2013.01)

(58) Field of Classification Search
None
See application file for complete search history.

(56) References Cited

U.S. PATENT DOCUMENTS 6,779,866 B2 8/2004 Junhua et al.
7,852,128 B2 12/2010 Kitazawa et al.
8,757,749 B2 * 6/2014 Oshima ..... B41J 2/04541 347/10

FOREIGN PATENT DOCUMENTS

JP 2005-125804 A 5/2005
JP 2009-190287 A 8/2009
JP 2010-114711 A 5/2010

* cited by examiner

*Primary Examiner* — Alejandro Valencia
(74) *Attorney, Agent, or Firm* — Global IP Couselors, LLP

(57) ABSTRACT

A liquid ejecting apparatus includes an ejecting unit that includes a piezoelectric element which is displaced by a first drive signal or a second drive signal; a first unit circuit that generates the first drive signal by using a first pair of transistors; a second unit circuit that generates the second drive signal by using a second pair of transistors; and an adjustment unit that delays at least one of a first control signal and a second control signal to supply the delayed control signal to a corresponding unit circuit, in a case where timing when a level of the first control signal for controlling the first pair of transistors changes and timing when a level of the second control signal for controlling the second pair of transistors changes are within a threshold time, and in a case where a predetermined condition is satisfied.

6 Claims, 15 Drawing Sheets

<DECODED CONTENT OF DECODER>

| | PRINT DATA SI | T1 | | T2 | |
|---|---|---|---|---|---|
| | | Sa | Sb | Sa | Sb |
| LARGE DOT | (1, 1) | H | L | H | L |
| MEDIUM DOT | (0, 1) | H | L | L | H |
| SMALL DOT | (1, 0) | L | L | L | H |
| NO RECORD | (0, 0) | L | H | L | L |

MSB LSB

LIQUID EJECTING APPARATUS AND DRIVE CIRCUIT

The entire disclosure of Japanese Patent Application No. 2016-034999, filed Feb. 26, 2016 is expressly incorporated by reference herein.

BACKGROUND

1. Technical Field

The present invention relates to a liquid ejecting apparatus and a drive circuit.

2. Related Art

An ink jet printer (liquid ejecting apparatus) which uses a piezoelectric element, for example, a piezo element is known as a printing apparatus which prints an image or a text by ejecting ink. Piezoelectric elements are provided in correspondence with multiple nozzles in a head unit, each of the piezoelectric elements is driven in response to a drive signal, and thereby, a predetermined amount or ink (liquid) is ejected from the nozzle at predetermined timing to form dots. Since the piezoelectric element is electrically a capacitive load like a capacitor, a sufficient current is required to operate the piezoelectric element of each nozzle.

Accordingly, a liquid ejecting apparatus has a configuration in which a source drive signal that is a source signal of a drive signal is amplified by an amplification circuit, and the amplified signal is supplied to a head unit as a drive signal to drive piezoelectric elements. An amplification circuit uses, for example, a method (linear amplification, refer to JP-A-2009-190287) of amplifying current for the source drive signal in class AB amplification or the like. However, power consumption increases and energy efficiency decreases in the linear amplification, and thus, in recent years, a technique or amplifying the source drive signal by switching a pair of transistors including a high-side transistor and a low-side transistor, such as class D amplification (refer to JP-A-2010-114711) is proposed.

Meanwhile, a technique is proposed in which multiple drive signals are generated to increase the number of gradations to be represented, multiple types of drive pulses are included in multiple drive signals, and one drive pulse or multiple drive pulses combined together are applied to a piezoelectric element (refer to JP-A-2005-125804).

Hence, a configuration has been studied in which each of the multiple drive signals is amplified by switching a pair of transistors.

However, in the aforementioned configuration, a relatively large current flows according to turn-on of one of a pair of transistors. Accordingly, when transistors of two or more drive circuits are turned on simultaneously, other circuits are affected by noise or the like caused by the turn-on, and thereby, problems may occur in which reproducibility of a waveform of a drive signal is reduced and print quality is reduced.

SUMMARY

An advantage of some aspects of the invention is to provide a liquid ejecting apparatus and a drive circuit which are less affected by noise or the like in a case where each of multiple drive signals is amplified toy switching a pair of transistors.

A liquid ejecting apparatus according to an aspect of the invention includes an ejecting unit that includes a piezoelectric element which is displaced by a first drive signal or a second drive signal being applied to the piezoelectric element and ejects liquid in accordance with displacement of the piezoelectric element; a first unit circuit that generates the first drive signal by using a first pair of transistors; a second unit circuit that generates the second drive signal by using a second pair of transistors and an adjustment unit that delays at least one of a first control signal and a second control signal to supply the delayed control signal to a corresponding unit circuit, in a case where timing when a level of the first control signal for controlling the first pair of transistors changes and timing when a level of the second control signal for controlling the second pair of transistors changes are within a threshold time and a predetermined condition is satisfied.

According to the liquid ejecting apparatus of the aspect, occurrence of spike noise is prevented in the first unit circuit and the second unit circuit, and a noise-induced malfunction and waveform disturbance is reduced. Thereby, a drive signal can be accurately generated, and thus, it is possible to increase print quality.

In the liquid ejecting apparatus according to the aspect, the first pair of transistors may include a first high-side transistor and a first low-side transistor, the second pair of transistors may include a second high-side transistor and a second low-side transistor, and the predetermined condition may be a condition that both of the first high-side transistor and the second high-side transistor are turned on, or both of the first low-side transistor and the second low-side transistor are turned on.

In the liquid ejecting apparatus according to the aspect, the first unit circuit may include a plurality of pairs of transistors each pair being the first pair of transistors and a first selector that selects any one of the plurality of first pairs of transistors and supplies the first control signal which is delayed or not delayed by the adjustment unit to the selected first pair of transistors, and the second unit circuit may include a plurality of pairs of transistors each pair being the second pair of transistors; and a second selector that selects any one of the plurality of second pairs of transistors and supplies the second control signal which is delayed or not delayed by the adjustment unit to the selected second pair of transistors.

In addition, in the liquid ejecting apparatus according to the aspect, the first control signal may be output, based on a first source drive signal which is a source signal of the first drive signal, and a signal based on the first drive signal, and the second control signal may be output, based on a second source drive signal which is a source signal of the second drive signal, and a signal based on the second drive signal.

The liquid ejecting apparatus may eject liquid, and examples of the liquid ejecting apparatus include a three-dimensional shaping apparatus (so-called 3D printer), a textile printing apparatus, and the like, in addition to a printing apparatus which will be described below.

In addition, the invention is not limited to a liquid ejecting apparatus, can be realized in various aspects, and can be conceptualized as a drive circuit which drives a capacitive load such as the piezoelectric element, a head unit of a liquid ejecting apparatus, or the like.

BRIEF DESCRIPTION OF THE DRAWINGS

The invention will be described with reference to the accompanying drawings, wherein like numbers reference like elements.

DESCRIPTION

Hereinafter, a printing apparatus according to an exemplary embodiment of the invention will be described with reference to the drawings.

Figure 1:
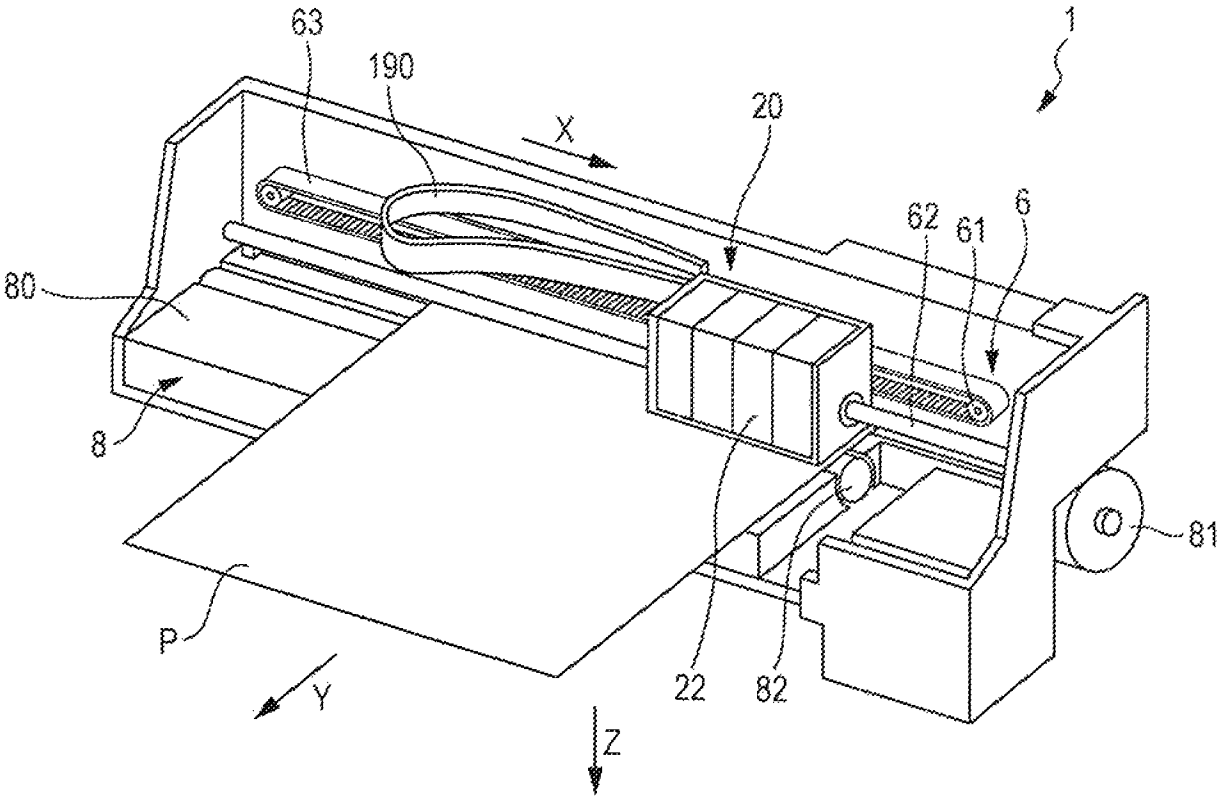
FIG. 1 is a perspective view illustrating a schematic configuration of a printing apparatus.

FIG. 1 is a perspective view illustrating a schematic configuration of a printing apparatus.

The printing apparatus illustrated in this figure is a type of liquid ejecting apparatus which elects ink that is an example of liquid, thereby, forming an ink dot group on a medium P such as paper, thus, printing an image (including characters, graphics, or the like).

As illustrated in FIG. 1, the printing apparatus 1 includes a moving mechanism 6 which moves (moves back and forth) a carriage 20 in a main scanning direction (X direction).

The moving mechanism 6 includes a carriage motor 61 which moves the carriage 20, a carriage guide axis 62 both ends of which are fixed, and a timing belt 63 which extends substantially parallel to the carriage guide axis 62 and is driven by the carriage motor 61.

The carriage 20 is supported by the carriage guide axis 62 so as to move freely back and forth, and is fixed to a part of the timing belt 63. Accordingly, if the timing belt 63 travels forward and backward by the carriage motor 61, the carriage 26 is guided by the carriage guide axis 62 and moves back and forth.

A printing head 22 is mounted on the carriage 20. The printing head 22 includes at a portion facing the medium P multiple nozzles which respectively eject ink in the Z direction. The printing head 22 is divided into approximately four blocks for color printing. The multiple blocks respectively eject black (Bk) ink, cyan (C) ink, magenta (M) ink, and yellow (Y).

The carriage 20 has a configuration in which various control signals or the like, which include a drive signal are supplied from a main substrate (omitted in FIG. 1) through a flexible flat cable 190.

The printing apparatus 1 includes a transport mechanism 8 which transports the medium P on a platen 80. The transport mechanism 8 includes a transport motor 81 which is a drive source, and a transport roller 82 which is rotated by the transport motor M and transports the medium P in a sub-scanning direction (Y direction).

In the configuration, an image is formed on a surface of the medium P by ejecting ink in accordance with print data from the nozzles of the printing head 22 along with main scanning of the carriage 20, and repeating an operation of transporting the medium P by the transport mechanism 8.

In the embodiment, the main scanning is performed by moving the carriage 20, but may be performed by moving the medium P, and may be performed by moving both the carriage 20 and the medium P. The point is that there may be provided a configuration in which the medium P and the carriage 20 (printing head 22) move relatively.

Figure 2A:
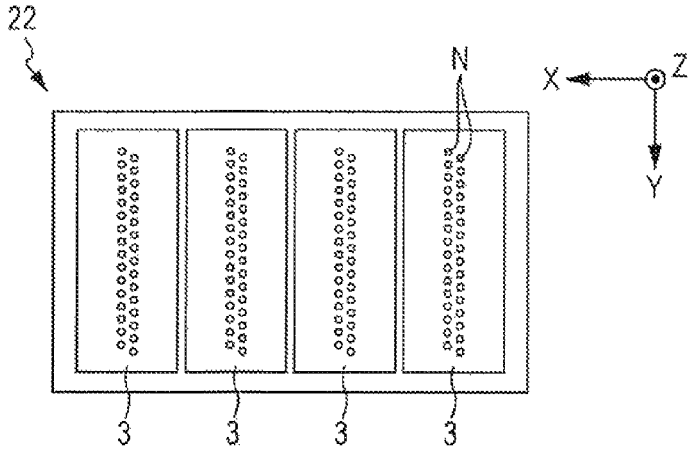
FIG. 2A is a diagram illustrating arrangement or the like of nozzles in a head unit.

FIG. 2A is a diagram illustrating a configuration in a case in which an ink ejecting surface of the printing head 22 is viewed from the medium P side. As illustrated in FIG. 2A, the printing head 22 includes four head units 3. The four head units 3 are arranged in the X direction which is a main scanning direction in correspondence with black (Bk), cyan (C), magenta (M), and yellow (Y), respectively.

Figure 2B:
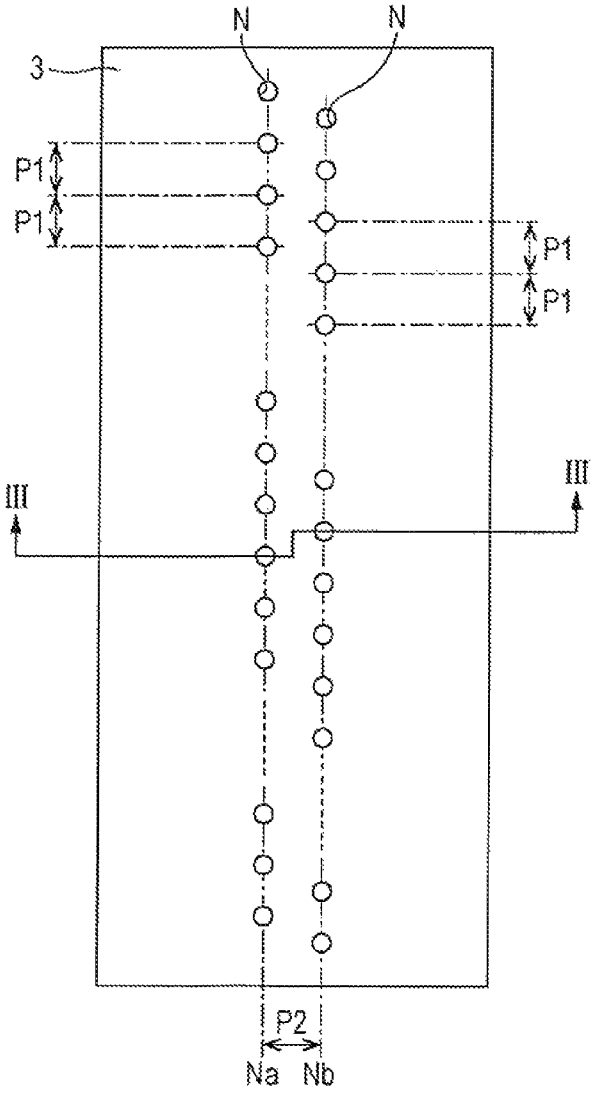
FIG. 2B is a diagram illustrating arrangement or the like of the nozzles in the head unit.

FIG. 2B is a diagram illustrating arrangement of nozzles in one head unit 3.

As illustrated in FIG. 2B, multiple nozzles N are arranged in two columns in one head unit 3. For the sake of convenience, the two columns are respectively referred to as a nozzle column Na and a nozzle column Nb.

Multiple nozzles N are respectively arranged in the Y direction which is a subscan direction with a pitch P1 in the nozzle columns Na and Nb. In addition, the nozzle columns Na and Nb are separated from each other with a pitch P2 in the X direction. The nozzles N in the nozzle column Na are shifted from the nozzles N in the nozzle column Nb by half the pitch P1 in the Y direction.

In this way, the nozzles N are arranged so as to be shifted by half the pitch P1 with respect to the two columns of the nozzle columns Na and Nb in the Y direction, and thus it is possible to increase resolution in the Y direction substantially twice as much as a case of providing one column.

The number of nozzles N in one head unit 3 is referred to as m (m is an integer greater than or equal to 2) for the sake of convenience.

While not particularly illustrated, the head unit 3 has a configuration in which a flexible circuit board is coupled to an actuator substrate, and a drive IC is mounted on the flexible circuit board. Hence, next, a structure of the actuator substrate will be described.

Figure 3:
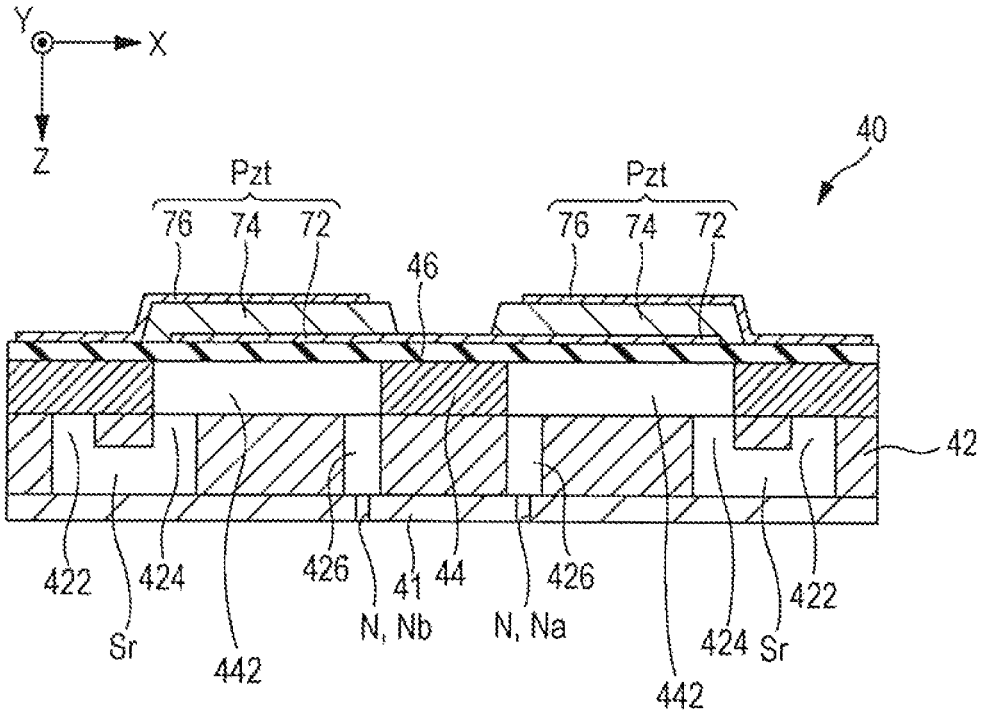
FIG. 3 is a sectional view illustrating a main configuration of the head unit.

FIG. 3 is a sectional view illustrating a structure of the actuator substrate. In detail, FIG. 3 is a view illustrating a cross section taken along line III-III of FIG. 2B.

As illustrated in FIG. 3, the actuator substrate 40 has a structure in which a pressure chamber substrate 44 and a vibration plate 46 are provided on a surface on a negative side in the Z direction and a nozzle plate 41 is provided on a surface on a positive side in the Z direction, in a flow path substrate 42.

Schematically, each element of the actuator substrate 40 is a member of an approximately flat place which is long in the Y direction, and is fixed to each other by, for example, an adhesive or the like. In addition, the flow path substrate 42 and the pressure chamber substrate 44 are formed by, for example, a single crystal substrate of silicon.

The nozzles N are formed in the nozzle plate 41. A structure corresponding to the nozzles in the nozzle column Na is shifted from a structure corresponding to the nozzles in the nozzle column Nb by half the pitch P1 in the Y direction, but the nozzles are formed approximately symmetrically except for that, and thus, the structure of the actuator substrate 40 will be hereinafter described by focusing on the nozzle column Na.

The flow path substrate 42 is a flat member which forms a flow path of ink, and includes an opening 422, a supply flow path 424, and a communication flow path 426. The supply flow path 424 and the communication flow path 426 are formed in each nozzle, and the opening 422 is continuously formed over the multiple nozzles and has a structure in which ink with a corresponding color is supplied. The opening 422 functions as a liquid reservoir chamber Sr, and a bottom surface of the liquid reservoir chamber Sr is configured by, for example, the nozzle plate 41. In detail, the nozzle plate 41 is fixed to the bottom surface of the flow path substrate 42 so as to close the opening 422, the supply flow path 424, and the communication flow path 426 which are in the flow path substrate 42.

The vibration plate 46 is installed on the pressure chamber substrate 44 on a surface on a side opposite to the flow path substrate 42. The vibration plate 46 is a member of an elastically vibratile flat plate, and is configured by stacking an elastic film formed of an elastic material such as a silicon oxide, end an insulating film formed of an insulating material such as a zirconium oxide. The vibration plate 46 and the flow path substrate 42 face each other with an interval in the inner side of each opening 422 of the pressure chamber substrate 44. A space between the flow path substrate 42 and the vibration plate 46 in the inner side of each opening 422 functions as a cavity 442 which provides pressure to ink. Each cavity 442 communicates with the nozzle N through the communication flow path 426 of the flow path substrate 42.

A piezoelectric element Pzt for each nozzle N (cavity 442) is formed on the vibration plate 46 on a surface on a side opposite to the pressure chamber substrate 44.

The piezoelectric element Pzt includes a common drive electrode 72 formed over the multiple piezoelectric elements Pzt formed on a surface of the vibration plate 46, a piezoelectric body 74 formed on a surface of the drive electrode 72, and individual drive electrodes 76 formed in each piezoelectric element Pzt on a surface of the piezoelectric body 74. In such a configuration, a region in which the piezoelectric body 74 interposed between the drive electrode 72 and the drive electrode 76 which face each other, functions as the piezoelectric element Pzt.

The piezoelectric body 74 is formed in a process which includes, for example, a heating process (baking). In detail, the piezoelectric body 74 is formed by baking a piezoelectric material which is applied to a surface of the vibration plate 46 on which multiple drive electrodes 72 are formed, using heating processing in a furnace, and then molding (milling by using, for example, plasma) the baked material for each piezoelectric element Pzt.

In the same manner, the piezoelectric element Pzt corresponding to the nozzle column Nb is also configured to include the drive electrode 72, the piezoelectric body 74, and the drive electrode 76.

In addition, in this example, with respect to the piezoelectric body 74, the common drive electrode 72 is a lower layer and the individual drive electrodes 76 are an upper layer, however, a configuration in which the common drive electrode 72 is an upper layer and the individual drive electrodes 76 are a lower layer, may be provided.

A configuration may be provided in which the drive IC is directly mounted in the actuator substrate 40.

As will be described below, a voltage Vout of a drive signal according to the amount of ink to be ejected is individually applied to the drive electrode 76 which is a terminal of the piezoelectric element Pzt, and a retention signal of a voltage $V_{BS}$ applied in common to the drive electrode 72 which is the other terminal of the piezoelectric element Pzt.

Accordingly, the piezoelectric element Pzt is displaced upwardly or downwardly in accordance with a voltage which is applied to the drive electrodes 72 and 76. In detail, if the voltage Vout of the drive signal which is applied through the drive electrode 76 decreases, the central portion of the piezoelectric element Pzt is bent upwardly with respect to both end portions, and meanwhile, if the voltage Vout increases, the central portion of the piezoelectric element Pzt is bent downwardly.

If the central portion is bent upwardly, an internal volume of the cavity 442 increases (pressure decreases), and thus ink is drawn from the liquid reservoir chamber Sr. Meanwhile, if the central portion is bent downwardly, an internal volume of the cavity 442 decreases (pressure increases), and thus, an ink droplet is ejected from the nozzle N in accordance with the decreased degree. In this way, if a proper drive signal is applied to the piezoelectric element Pzt, ink is ejected from the nozzle N in accordance with the displacement of the piezoelectric element Pzt. Accordingly, an ejecting unit which ejects ink is configured with at least the piezoelectric element Pzt, the cavity 442, and the nozzle N.

Next, an electrical configuration of the printing apparatus 1 will be described.

Figure 4:
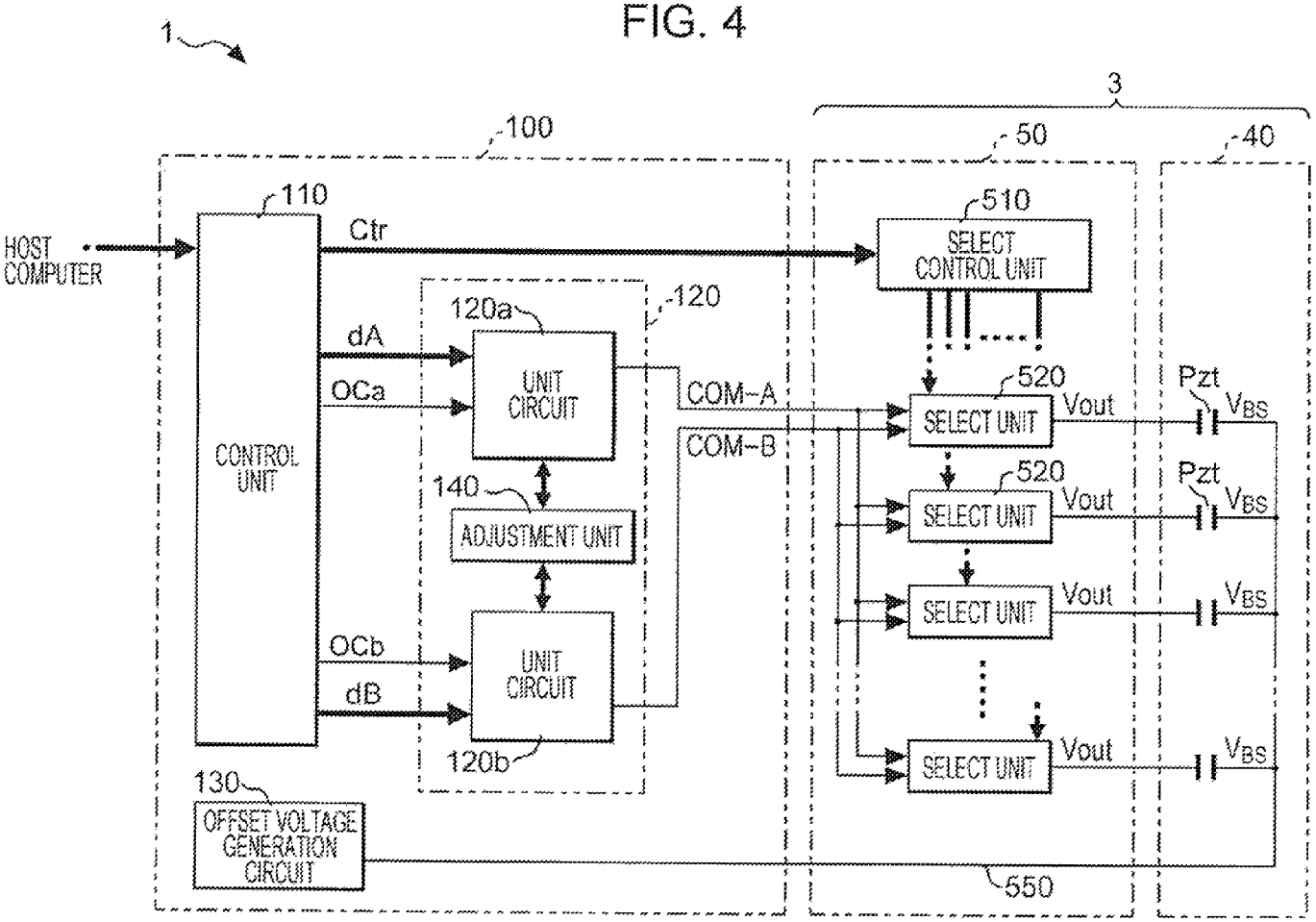
FIG. 4 is a block diagram illustrating an electrical configuration of the printing apparatus.

FIG. 4 is a block diagram illustrating an electrical configuration of the printing apparatus 1.

As illustrated in FIG. 4, the printing apparatus 1 has a configuration in which the head unit 3 is coupled to a main substrate 100. The head unit 3 is substantially divided into the actuator substrate 40 and a drive IC 50.

The main substrate 100 supplies a control signal Ctr or drive signals COM-A and COM-B to the drive IC 50, and supplies a retention signal of the voltage $V_{BS}$ (offset voltage) to the actuator substrate 40 through a wire 550.

In the printing apparatus 1, four head units 3 are provided, and the main substrate 100 independently control the four head units 3. The four head units 3 are the same as each other except that the colors of ink to be ejected are different from each other, and thus, hereinafter, one head unit 3 will be representatively described for the sake of convenience.

As illustrated in FIG. 4, the main substrate 100 includes a control unit 110, a drive circuit 120, and an offset voltage generation circuit 130.

Among these, the control unit 110 is a type of a microcomputer having a CPU, a RAM, a ROM, and the like, and outputs various control signals or the like for controlling each unit by executing a predetermined program, when image data which is a printing target is supplied from a host computer or the like.

In detail, first, the control unit 110 supplies digital data dA which defines a waveform of the drive signal COM-A and digital data dB which defines a waveform of the drive signal COM-B to the drive circuit 120. As will be described below, the waveforms of the drive signal COM-A and the drive signal COM-B are trapezoidal waveforms and have periodicity, and thus, the control unit 110 repeatedly supplies the data dA and dB with trapezoidal waveforms.

The drive circuit 120, which will be described below in detail, includes unit circuits 120*a* and 120*b* and an adjustment unit 140. Among these, the unit circuit (first unit circuit) 120*a* converts the data dA into an analog signal, amplifies a voltage of the analog signal, increases drive capability (converts into low impedance) of the signal by using a signal OCa, and outputs the signal as the drive signal COM-A (first drive signal) to the piezoelectric element Pzt which is a capacitive load. In the same manner, the unit circuit (second unit circuit) 120*b* converts the data dB into an analog signal, amplifies a voltage of the analog signal, converts the signal into a signal with low impedance by using a signal OCb, and outputs the signal as the drive signal COM-B (second drive signal) to the piezoelectric element Pzt.

In addition, the control unit 110 outputs the signals OCa and OCb with respect to the trapezoidal waveforms of the drive signals COM-A and COM-B, but these signals will be described after describing an example of the drive signals COM-A and COM-B.

Second, the control unit 110 supplies various control signals Ctr to the head unit 3, in synchronization with control for the moving mechanism 6 and the transport mechanism 8. The control signals Ctr which are supplied to the head unit 3 include print data (ejecting control signal) which defines the amount of ink which is ejected from the nozzle N, a clock signal which is used for transmission of the print data, and a timing signal which defines a print period or the like.

The control unit 110 controls the moving mechanism 6 and the transport mechanism 8, but such a configuration is known, and thus, description thereof will be omitted.

The offset voltage generation circuit 130 in the main substrate 100 generates a retention signal of the voltage $V_{BS}$ and applies in common the signal to the other terminals of the multiple piezoelectric elements Pzt in the actuator substrate 40 through the wires 550. The retention signal of the voltage $V_{BS}$ maintains the other terminals of the multiple piezoelectric elements Pzt in a constant state.

Meanwhile, the head unit 3 has a configuration in which a flexible circuit substrate is coupled to the actuator substrate 40 and the drive IC 50 is mounted on the flexible circuit substrate, as described above. Among these, the drive IC 50 includes a select control unit 510 and select units 520 which correspond to the piezoelectric elements Pzt one to one. Among these, the select control unit 510 controls selection of each of the select units 520. In detail, the select control unit 510 stores once the print data which is supplied in correspondence with a clock signal from the control unit 110 by the amount of some nozzles (piezoelectric elements Pzt) of the head unit 3, and instructs each select unit 520 to select the drive signals COM-A or COM-B in accordance with the print data at a start timing of a print period which is defined by a timing signal.

Each select unit 520 selects (or does not select any one) one of the drive signals COM-A and COM-B in accordance with instruction of the select control unit 510, and applies the selected signal to one terminal of the corresponding piezoelectric element Pzt as a drive signal of the voltage Vout.

As described above, one piezoelectric element Pzt is provided for each nozzle N in the actuator substrate 40. The other terminals of piezoelectric elements Pzt are coupled in common, and the voltage $V_{BS}$ from the offset voltage generation circuit 130 is applied to the other terminals through the wire 550.

In the embodiment, ink is ejected from one nozzle N twice at the maximum for one dot, and thus four gradations of a large dot, a medium dot, a small dot, and no record are represented. In the embodiment, in order to represent the four gradations, two types of the drive signals COM-A and COM-B are prepared, and each period has first half pattern and a second half pattern. Then, in one period, the drive signals COM-A and COM-B are selected (or not selected) in accordance with a gradation to be represented in the first half and a second half, and the selected signal is supplied to the piezoelectric element Pzt.

Thus, the drive signals COM-A and COM-B will be first described, and thereafter, a detailed configuration of the select control unit 510 for selecting the drive signals COM-A and COM-B, and the select unit 520 will be described.

FIG. 3 is a diagram illustrating waveforms and the like of drive signals COM-A and COM-B.

Figure 5:
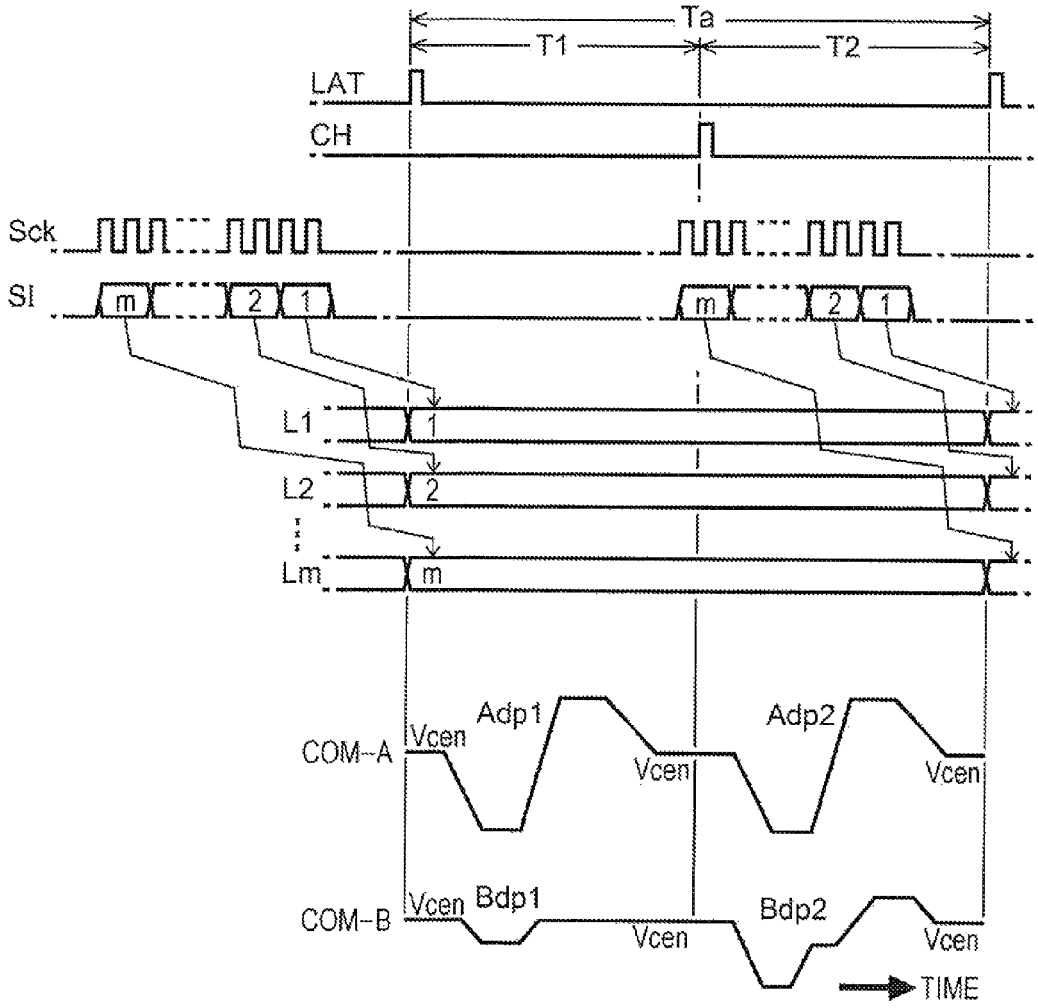
FIG. 5 is a diagram illustrating waveforms and the like of drive signals.

As illustrated in FIG. 5, the drive signal COM-A is configured by a repeated waveform of a trapezoidal waveform Adp1 which is disposed in a period T1 from time when a control signal LAT is output (rises) to time when a control signal CH is output, in a print period Ta, and a trapezoidal waveform Adp2 which is disposed in a period T2 from time when the control signal CH is output and to the control signal LAT is output in the print period Ta.

In the embodiment, the trapezoidal waveforms Adp1 and Adp2 are approximately the same waveforms as each other, and are waveforms which eject ink of a predetermined amount, specifically, an approximately medium amount from the nozzle N corresponding to the piezoelectric elements Pzt, if each waveform is supplied to the drive electrode 76 which is one terminal of the piezoelectric elements Pzt.

The drive signal COM-B is configured by a repeated waveform of a trapezoidal waveform Bdp1 which is disposed in the period T1 and a trapezoidal waveform Bdp2 which is disposed in the period T2. In the embodiment, the trapezoidal waveforms Bdp1 and Bdp2 are waveforms different form each other. Among these, the trapezoidal waveform Bdp1 is a waveform for preventing an increase in viscosity of ink by slightly vibrating the ink near the nozzle N. Accordingly, even if the trapezoidal waveform Bdp1 is supplied to the one terminal of the piezoelectric element Pzt, ink is not ejected from the nozzle N corresponding to the piezoelectric element Pzt. In addition, the trapezoidal waveform Bdp2 is a waveform different from the trapezoidal waveform Adp1 (Adp2). The trapezoidal waveform Bdp2 is a waveform which ejects the amount of ink less than the predetermined amount from the nozzle N corresponding to the piezoelectric element Pzt. If the trapezoidal waveform Bdp2 is supplied to the one terminal of the piezoelectric element Pzt.

Voltages at a start timing of the trapezoidal waveforms Adp1, Adp2, Bdp1, and Bdp2, and voltages at an end timing of the trapezoidal waveforms Adp1, Adp2, Bdp1, and Bdp2 are all common at a voltage Vcen. That is, the trapezoidal waveforms Adp1, Adp2, Bdp1, and Bdp2 are waveforms which respectively start at the voltage Vcen and ends at the voltage Vcen.

The control unit 110 outputs a signal QCa having the following logic level with respect to the trapezoidal waveform of the drive signal COM-A to the drive circuit 120. In detail, the control unit 110 causes the signal OCa to be in a High (H) level during a period is which a voltage of the drive signal COM-A decreases and a period in which the drive signal COM-A is constant at a voltage lower than a threshold value Vth, and other than that, to be in a Low (L) level during a period in which the voltage of the drive signal COM-A increases and a period in which the drive signal COM-A is constant at a voltage equal to or higher than the threshold value Vth.

Here, in the present example, when a maximum value of the voltage of the drive signal COM-A is referred to as max and a minimum value thereof is referred to as min, description will be made by assuming that a relationship of max>Vth>Vcen>min is satisfied for the sake of convenience. The relationship may be max>Vcen>Vth>min.

In addition, the control unit 110 outputs a signal OCb having the following logic level with respect to the trapezoidal waveform of the drive signal COM-B to the drive circuit 120. In detail, the control unit 110 causes the signal OCb to be in a H level during a period in which a voltage of the drive signal COM-B decreases and a period in which the drive signal COM-B is constant at a voltage lower than the threshold value Vth, and other than that, to be in a L level during a period in which the voltage of the drive signal COM-B increases and a period in which the drive signal COM-B is constant at a voltage equal to or higher than the threshold value Vth.

Description will return to each unit of the head unit 3 of FIG. 4, particularly the drive IC 50.

Figure 6:
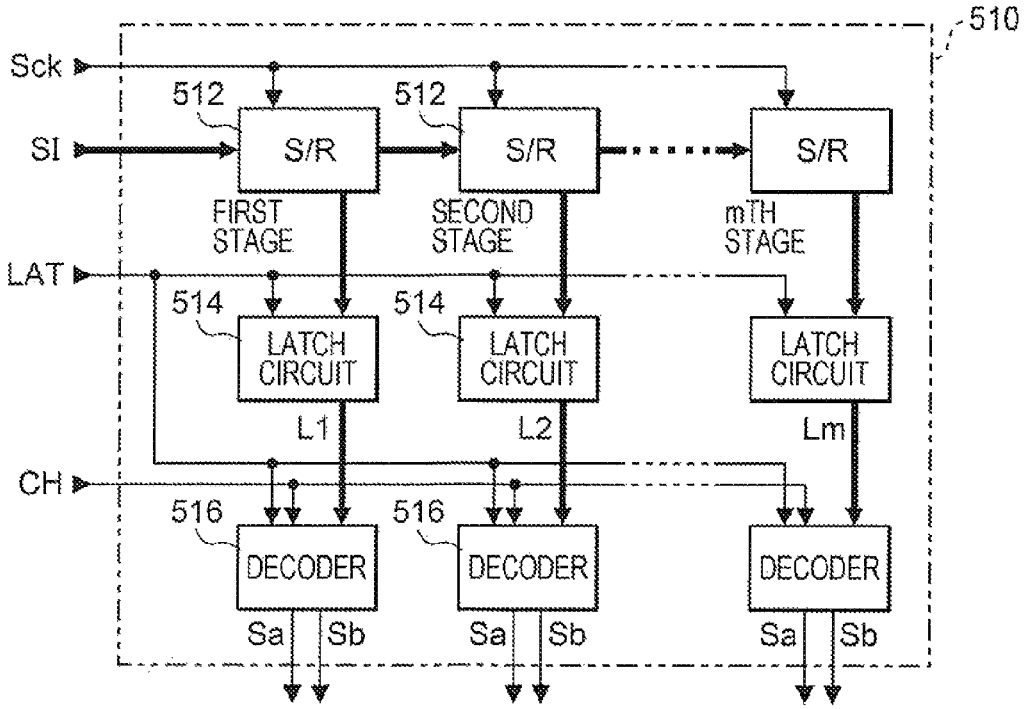
FIG. 6 is a diagram illustrating a configuration of a select control unit.

FIG. 6 is a diagram illustrating a configuration of the select control unit 510 in the drive IC 50.

As illustrated in FIG. 6, a clock signal Sck, the print data SI, and the control signals LAT and CH are supplied to the select control unit 510. Multiple sets of a shift register (S/R) 512, a latch circuit 514, and a decoder 516 are provided in correspondence with each of the piezoelectric elements Pzt (nozzles N) in the select control unit 510.

The print data SI is data which defines dots to be formed during the print period Ta by all the nozzles N in the head unit 3 which is focused. In the embodiment, in order to represent the four gradations of no record, a small dot, a medium dot, and a large dot, the print data for one nozzle is configured by two bits of a most significant bit (MSB) and a least significant bit (LSB).

The print data SI is supplied in accordance with transport of the medium P for each nozzle N (piezoelectric element Pzt) in synchronization with the clock signal Sck. The shift register 512 has a configuration in which the print data SI of two bits is retained once in correspondence with the nozzle N.

In detail, shift registers 512 of total m stages corresponding to m piezoelectric elements Pzt (nozzles) are coupled in cascade, and the print data SI which is supplied to the shift register 512 of a first stage located at a left end in FIG. 6 is sequentially transmitted to the rear stage (downstream side) in accordance with the clock signal Sck.

In FIG. 6, in order to separately recognize the shift registers 512, the shift register 512 are sequentially referred to as a first stage, a second stage, . . . , an mth stage from the upstream side to which the print data SI is supplied.

The latch circuit 514 latches the print data SI retained in the shift register 512 at a rising edge of the control signal LAT.

The decoder 516 decodes the print data SI of two bits which are latched in the latch circuit 514, outputs select signals Sa and Sb for each of periods T1 and T2 which are defined by the control signal LAT and the control signal CH, and defines selection of the select unit 520.

Figures 7, 8:
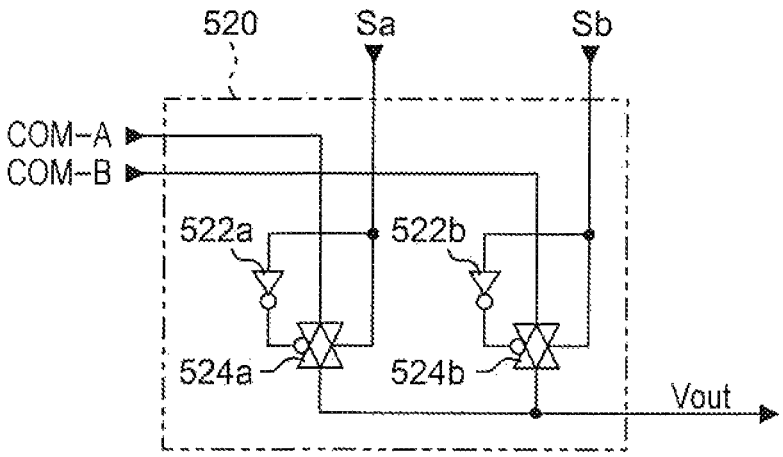
FIG. 7 is a diagram illustrating decoded content of a decoder.
FIG. 8 is a diagram illustrating a configuration of unit.

FIG. 7 is a diagram illustrating decoded content of the decoder 516.

In FIG. 7, the print data SI of two bits which are latched is referred to as an MSB and an LSB. In the decoder 516, if the latched print data SI is (0,1), it means that logic levels of the select signals Sa and Sb are respectively output as levels of H and L during the period T1, and levels of L and H during the period T2.

The logic levels of the select signals Sa and Sb are level-shifted by a level shifter (not illustrated) to a higher amplitude logic than the logic levels of the clock signal Sck, the print data SI, and the control signals LAT and CH.

FIG. 8 is a diagram illustrating a configuration of the select unit 520 of FIG. 4.

As illustrated in FIG. 8, the select unit 520 includes inverters (NOT circuit) 522*a* and 522*b*, and transfer gates 524*a* and 524*b*.

The select signal Sa from the decoder 516 is supplied to a positive control terminal to which a round mark is not attached in the transfer gate 524*a*, is logically inverted by the inverter 522*a*, and is supplied to a negative control terminal to which a round mark is attached in the transfer gate 524*a*. In the same manner, the select signal Sb is supplied to a positive control terminal of the transfer gate 524*b*, is logically inverted by the inverter 522*b*, and is supplied to a negative control terminal of the transfer gate 524*b*.

The drive signal COM-A is supplied to an input terminal of the transfer gate 524*a*, and the drive signal COM-B is supplied to an input terminal of the transfer gate 524*b*. The output terminals of the transfer gates 524*a* and 524*b* are coupled to each other, and are coupled to one terminal of the corresponding piezoelectric element Pzt.

If the select signal Sa is in a H level, the input terminal and the output terminal of the transfer gate 524*a* are electrically coupled (ON) to each other. If the select signal Sa is in a L level, the input terminal and the output terminal of the transfer gate 524*a* are electrically decoupled (OFF) from each other. In the same manner, the input terminal and the output terminal of the transfer gate 524*b* are also electrically coupled to each other or decoupled from each other in accordance with the select signal Sb.

As illustrated in FIG. 5, the print data SI is supplied for each nozzle is synchronization with the clock signal Sck, and is sequentially transmitted to the shift registers 512 corresponding to the nozzles. Thus, if supply of the clock signal Sck is stopped, the print data SI corresponding to each nozzle is retained in each of the shift registers 512.

If the control signal LAT rises, the latch circuits 514 latch all of the print data SI retained in the shift registers 512. In FIG. 5, the number in L1, L2, . . . , Lm indicates the print data SI which is latched by the latch circuit 514 corresponding to the shift register 512 of the first stage, the second stage, . . . , the mth stage.

The decoder 516 outputs the logic levels of the select signals Sa and Sb in the content illustrated in FIG. 7 in accordance with the size of the dots which are defined by the latched print data SI during the periods T1 and T2.

That is, first, the decoder 516 sets the select signals Sa and Sb to levels of H and L during the period T1 and levels of H and L even during the period T2, if the print data SI is (1,1) and the size of the large dot is defined. Second, the decoder 516 sets the select signals Sa and Sb to levels of H and L during the period T1 and levels of L and H during the period T2, if the print data SI is (0,1) and the size of the medium dot is defined. Third, the decoder 516 sets the select signals Sa and Sb to levels of L and L during the period T1 and levels of L and H during the period T2, if the print data SI is (1,0) and the size of the small dot is defined. Fourth, the decoder 516 sets the select signals Sa and Sb to levels of L and H during the period T1 and levels of L and L during the period T2, if the print data SI is (0,0) and no recode is defined.

Figure 9:
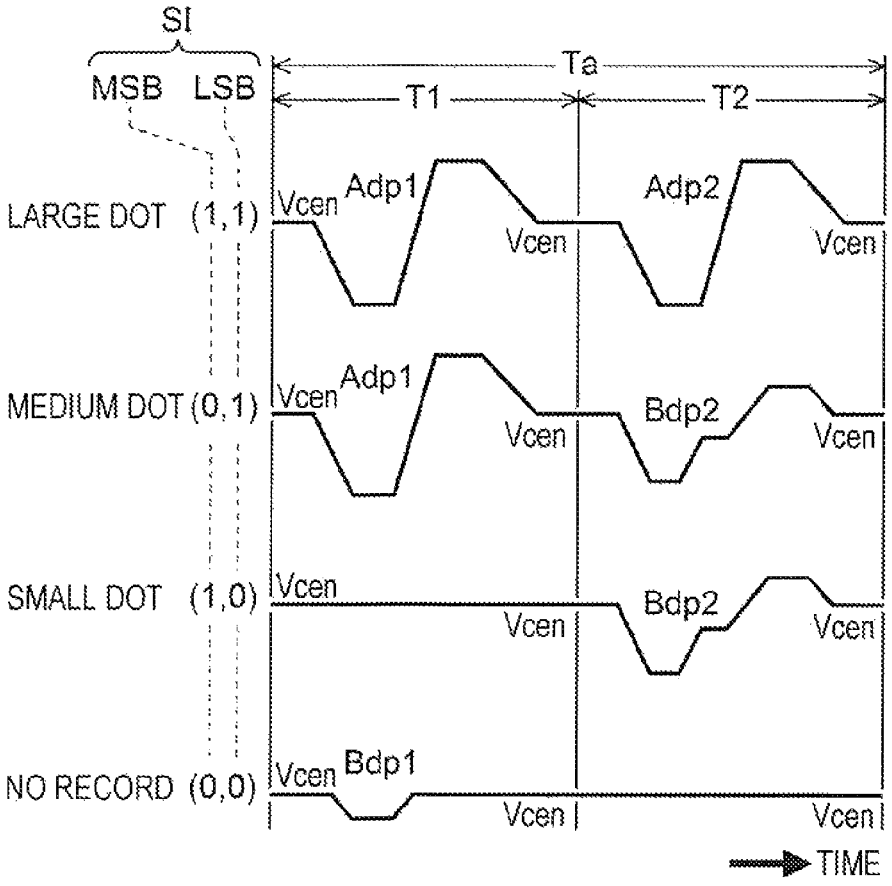
FIG. 9 is a diagram illustrating the drive signals which are supplied from the select unit to a piezoelectric element.

FIG. 9 is a diagram illustrating waveforms of the drive signals which are selected in accordance with the print data SI and are supplied to one terminal of the piezoelectric element Pzt.

When the print data SI is (1,1), the select signals Sa and Sb become H and L levels during the period T1, and thus the transfer gate 524*a* is turned on, and the transfer gate 524*b* is turned off. Accordingly, the trapezoidal waveform Adp1 of the drive signal COM-A is selected in the period T1. Since the select signals Sa and Sb are in H and L levels even during the period T2, the select unit 520 selects the trapezoidal waveform Adp2 of the drive signal COM-A.

In this way, if the trapezoidal waveform Adp1 is selected in the period T1, the trapezoidal waveform Adp2 is selected in the period T2, and the selected waveforms are supplied to one terminal of the piezoelectric element Pzt as drive signals, ink of an approximately medium amount is ejected twice from the nozzle N corresponding to the piezoelectric element Pzt. Accordingly, each ink is landed on and combined on the medium P, and as a result, a large dot is formed as defined by the print data SI.

When the print data SI is (0,1), the select signals Sa and Sb become H and L levels during the period T1, and thus the transfer gate 524*a* is turned on, and the transfer gate 524*b* is turned off. Accordingly, the trapezoidal waveform Adp1 of the drive signal COM-A is selected in the period T1. Next, since the select signals Sa and Sb are in L and H levels during the period T2, the trapezoidal waveform Bdp2 of the drive signal COM-B is selected.

Hence, ink of an approximately medium amount and an approximately small amount is ejected thus twice from the nozzle N. Accordingly, each ink is landed on and combined on the medium P, and as a result, a medium dot is formed as defined by the print data SI.

When the print data SI is (1,0), both the select signals Sa and Sb become L levels during the period T1, and thus the transfer gates 524*a* and 524*b* are turned off. Accordingly, the trapezoidal waveforms Adp1 and Bdp1 are not selected in the period T1. If the transfer gates 524*a* and 524*b* are all turned off, a path from a coupling point of the output terminals of the transfer gates 524*a* and 524*b* to one terminal of the piezoelectric element Pzt becomes a high impedance state in which the path is not electrically coupled to any portion. However, both terminals of the piezoelectric element Pzt retain a voltage ($Vcen-V_{BS}$) immediately before the transfer gates are turned off, by capacitance included in the piezoelectric element Pzt itself.

Next, since the select signals Sa and Sb are in L and H levels during the period T2, the trapezoidal waveform Bdp2 of the drive signal COM-B is selected. Accordingly, ink of an approximately small amount is ejected from the nozzle N only during the period T2, and thus small dot is formed on the medium P as defined by the print data SI.

When the print data SI is (0,0), the select signals Sa and Sb become L and H levels during the period T1, and thus the transfer gates 524*a* is turned off and the transfer gate 524*b* is turned on. Accordingly, the trapezoidal waveforms Bdp1 of the drive signal COM-B is selected in the period T1. Next, since both the select signals Sa and Sb are in L levels during the period T2, neither of the trapezoidal waveforms Adp2 and Bdp2 is selected.

Accordingly, ink near the nozzle N only slightly vibrates in the period T1, and the ink is not ejected, and thus, as a result, dots are not formed, that is, no record is made as defined by the print data SI.

In this way, the select unit 520 selects (or does not select) the drive signals COM-A and COM-B in accordance with instruction of the select control unit 510, and applies the selected signal to one terminal of the piezoelectric element Pzt. Accordingly, each of the piezoelectric elements Pzt is driven in accordance with the size of the dot which is defined by the print data SI.

The drive signals COM-A and COM-B illustrated in FIG. 5 are merely an example. Actually, combinations of various waveforms which are prepared in advance are used in accordance with properties, transport speed, or the like of the medium P.

In addition, here, an example in which the piezoelectric element Pzt is bent upwardly in accordance with a decrease of a voltage is used, but if a voltage which is applied to the drive electrodes 72 and 76 is inverted, the piezoelectric element Pzt is bent downwardly in accordance with a decrease of the voltage. Accordingly, in a configuration in which the piezoelectric element Pzt is bent downwardly in accordance with a decrease of a voltage, the drive signals COM-A and COM-B illustrated in the figure have waveforms which are inverted with respect to the voltage Vcen as a reference.

Next, the drive circuit 120 of the main substrate 100 will be described.

A symbol of the drive circuit is unified as 120, but since there are several aspects as will be describe below, there is a case where description in parentheses such as a drive circuit (Example 1) or a drive circuit (Example 2) is attached instead of a symbol so that each drive circuit is distinguished.

Figure 10:
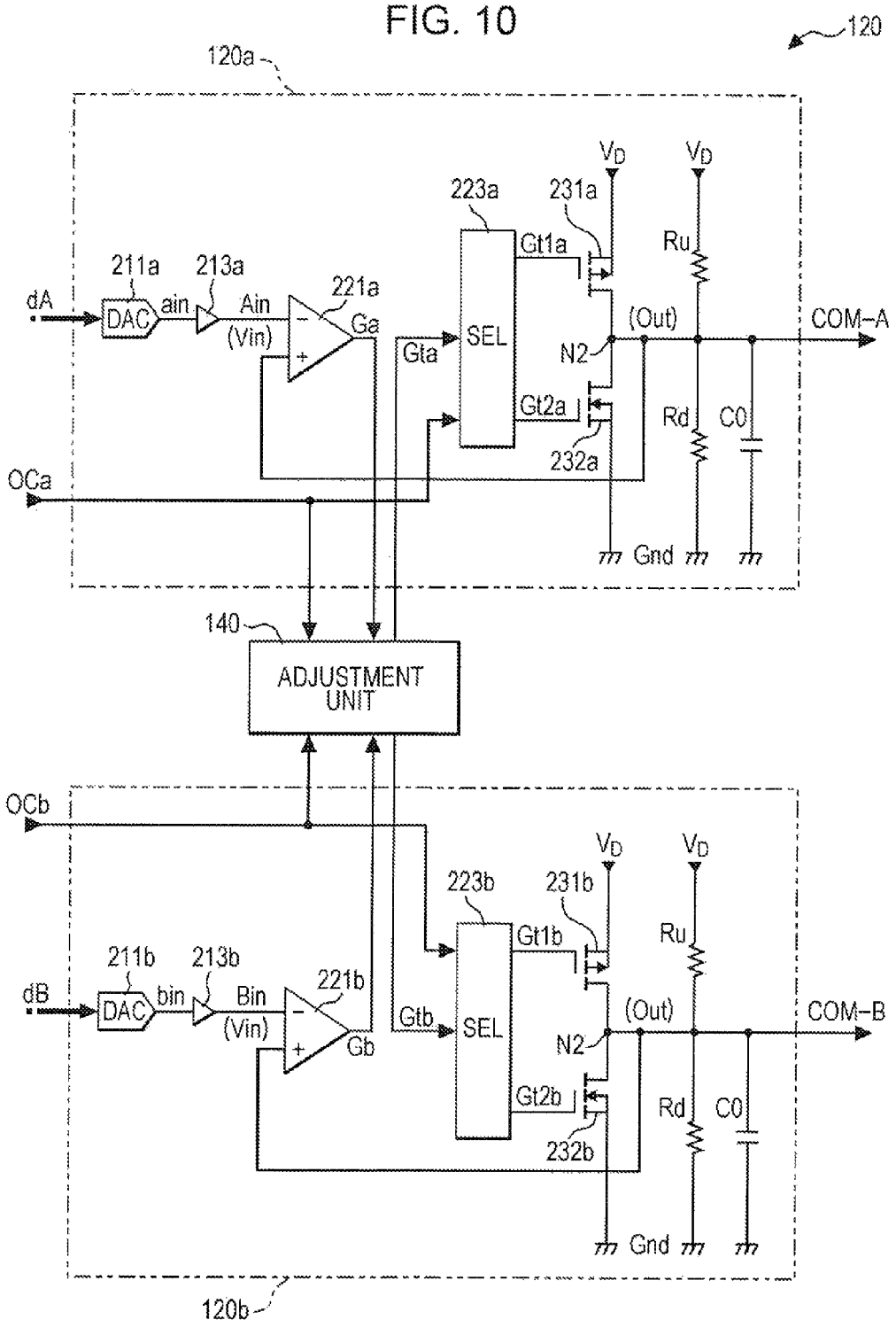
FIG. 10 is a diagram illustrating a drive circuit (Example 1) which is applied to the printing apparatus.

FIG. 10 is a diagram illustrating the drive circuit (Example 1).

The drive circuit (Example 1) includes the unit circuits 120*a* and 120*b* and the adjustment unit 140, and, among these, the unit circuit 120*a* receives the data dA and the signal OCa and outputs the drive signal COM-A, and the unit circuit 120*b* receives the data dB and the signal OCb and outputs the drive signal COM-B. In addition, as an intermediate signal, the unit circuit 120*a* supplies a signal Ga (first control signal) to the adjustment unit 140, and the unit circuit 120*b* supplies a signal Gb (second control signal) to the adjustment unit 140. The adjustment unit 140 returns the signal Ga to the unit circuit 120*a* as a signal Gta and returns the signal Gb to the unit circuit 120*b* as a signal Gtb, respectively.

Here, the unit circuits 120*a* and 120*b* have the same configuration and have different input signals and output signals, and thus, description will be made by focusing on the unit circuit 120*a*.

The unit circuit 120*a* includes a digital-to-analog converter (DAC) 211*a*, a voltage amplifier 213*a*, a differential amplifier 221*a*, a selector 223*a*, transistors 231*a* and 232*a*, resistance elements Ru and Rd, and a capacitor C0, as illustrated in FIG. 10.

The DAC 211*a* converts the digital data dA into an analog signal ain. The voltage amplifier 213*a* amplifies the voltage of the signal ain by, for example, 10 times and supplies the amplified signal to a negative input terminal (−) of the differential amplifier 221*a* as the signal Ain (first source drive signal). A voltage (here, signal Ain) which is applied to the negative input terminal (−) of the differential amplifier 221*a* is referred to as Vin.

In addition, the signal ain which is converted by the DAC 211*a* is a signal with relatively small amplitude of, for example, approximately zero to four volts, and in contrast to this, a voltage of the drive signal COM-A swings with relatively large amplitude of approximately zero to 40 volts. Accordingly, such a configuration is provided that a voltage of the signal ain that is converted by the DAC 211*a* is amplified by the voltage amplifier 213*a*, and the amplified signal Ain is impedance-converted.

In the present example, the unit circuit 120*a* impedance-converts the signal Ain to be output as the drive signal COM-A, and thus, a waveform of the signal Ain which is an input involves some errors, but may be approximately the same as a waveform of line drive signal COM-A. Meanwhile, since the signal Ain is obtained by amplifying the voltage of the signal ain by 10 times, and thus, the waveform of the signal ain is 1/10 of the voltage of the signal Ain. The signal ain is obtained by performing analog conversion of the data dA, and thus, a voltage waveform of the drive signal COM-A is defined by the data dA which is output by the control unit 110.

The drive signal COM-A which is an output is fed back to the negative input terminal (−) of the differential amplifier 221*a*. Accordingly, the differential amplifier 221*a* outputs the signal Ga of a difference voltage which is obtained by subtracting a voltage Vin of the negative input terminal (−) from a voltage of the positive input terminal (+), that is, a difference voltage which is obtained by subtracting the voltage Vin of the signal Ain that is an input from a voltage Out of the drive signal COM-A that is an output.

However, the differential amplifier 221*a* uses a high potential side of a power supply as a voltage $V_D$, and uses a low potential side thereof as a ground Gnd, while not particularly illustrated. Accordingly, an output voltage of the signal Ga is within a range from the ground Gnd to the voltage $V_D$.

There is a case where the signal Ga which is output from the differential amplifier 221*a* is also used as a signal for a switching operation which will be described below, and there is a case where the signal Ga is also used as a signal for a linear operation. In a case where the signal Ga is used as the signal for the switching operation, a H level indicates the voltage $V_D$, and a L level indicates the ground Gnd of a zero volts. In addition, since the signal Ga of the differential amplifier 221*a* controls switching operations and linear operations of transistors 231*a* and 232*a* after all as will be described below, the signal Ga can be said to be a control signal for the transistors.

In addition, a configuration may be provided in which a drive signal decreases to be fed back and a source drive signal is voltage-amplified to be output as the drive signal, and thus, it may be said that a signal based on the drive signal is fed back to the differential amplifier 221*a*.

The adjustment unit 140 will the described below in detail. The adjustment unit 140 detects a change of a level of the signal Ga from the unit circuit 120*a* and a change of a level of the signal Gb from the unit circuit 120*b*, and delays one of the signal Ga and the signal Gb in consideration of the signals OCa and OCb.

The adjustment unit 140 returns the signal Gta which is obtained by delaying or not delaying the signal Ga to the unit circuit 120*a*, and meanwhile, the adjustment unit 140 returns the signal Gtb which is obtained by delaying or not delaying the signal Gb to the unit circuit 120*b*.

If the signal OCa is in a L level, the selector (select unit) 223*a* of the unit circuit 120*a* selects the output signal Gta as a signal Gt1*a* to supply the signal to a gate terminal of the transistor 231*a*, and selects a L level as a signal Gt2*a* to supply the level to a gate terminal of the transistor 232*a*. Meanwhile, if the signal OCa is in a H level, the selector 223*a* of the unit circuit 120*a* selects a H level as the signal Gt1*a* to supply the level to the gate terminal of the transistor 231*a*, and selects the signal Gta as the signal Gt2*a* to supply the signal to the gate terminal of the transistor 232*a*.

In other words, if the signal OCa is in a L level, the selector 223*a* supplies the signal Gta to the gate terminal of the transistor 231*a* as the signal Gt1*a*, and supplies a L level which turns off the transistor 232*a* to the gate terminal of the transistor 232*a* as the signal Gt2*a*. Meanwhile, if the signal OCa is in a H level, the selector 223*a* supplies a H level which turns off the transistor 231*a* to the gate terminal of the transistor 231*a* the signal Gt1*a*, and supplies the signal Gta as the signal Gt2*a*.

A first pair of transistors are configured by transistors 231*a* and 232*a*. The transistor 231*a* (first high-side transistor) on a high side is, for example, a P-channel field effect transistor, and a high-side voltage $V_D$ of a power supply is applied to a source terminal thereof. The transistor 232*a* (first low-side transistor) on a low side is, for example, an N-channel field effect transistor, and a source terminal thereof is coupled to the ground Gnd which is a low side of the power supply.

In the unit circuit 120*a*, drain terminals of the transistors 231*a* and 232*a* are coupled to each other, and become a node N2 of an output terminal. That is, the drive signal COM-A is configured to be output from the node N2.

The node N2 is coupled to the positive input terminal (+) of the differential amplifier 221*a*, and is pulled up to the voltage $V_D$ through the resistance element Ru, while being pulled down to the ground through the resistance element Rd.

The capacitor C0 (output capacitor) is provided to prevent abnormal oscillation or the like from occurring, one terminal thereof is coupled to the node N2, and the other terminal 1 thereof is coupled to, for example, the ground Gnd which is a constant potential.

In the unit circuit 120*b* which outputs the drive signal COM-B, the DAC 211*b* converts the data dB into an analog signal bin with a small amplitude, and the voltage amplifier 213*b* amplifies the voltage of the signal bin by 10 times in the same manner to convert the voltage into a signal with a large amplitude and supplies the amplified signal to a negative input terminal (−) of the differential amplifier 221*b* as the signal Bin (second source drive signal). In addition, the differential amplifier 221*b* outputs the signal Gb. If the signal OCb is in a L level, the selector 223*b* selects the output signal Gtb as a signal Gt1*b* to supply the signal to a gate terminal of the transistor 231*b*, and selects a L level as a signal Gt2*b* to supply the level to a gate terminal of the transistor 232*b*. Meanwhile, if the signal OCb is in a H level, the selector 223*b* selects a H level as the signal Gt1*b* to supply the level to the gate terminal of the transistor 231*b*, and selects the signal Gtb as the signal Gt2*b* to supply the signal to the gate terminal of the transistor 232*b*.

In the unit circuit 120*b*, a second pair of transistors are configured by the transistor 231*b* (second high-side transistor) and the transistor 232*b* (second low-side transistor).

Here, a drive circuit according to a comparative example will be described before an operation of the drive circuit 120 is described.

Figure 16:
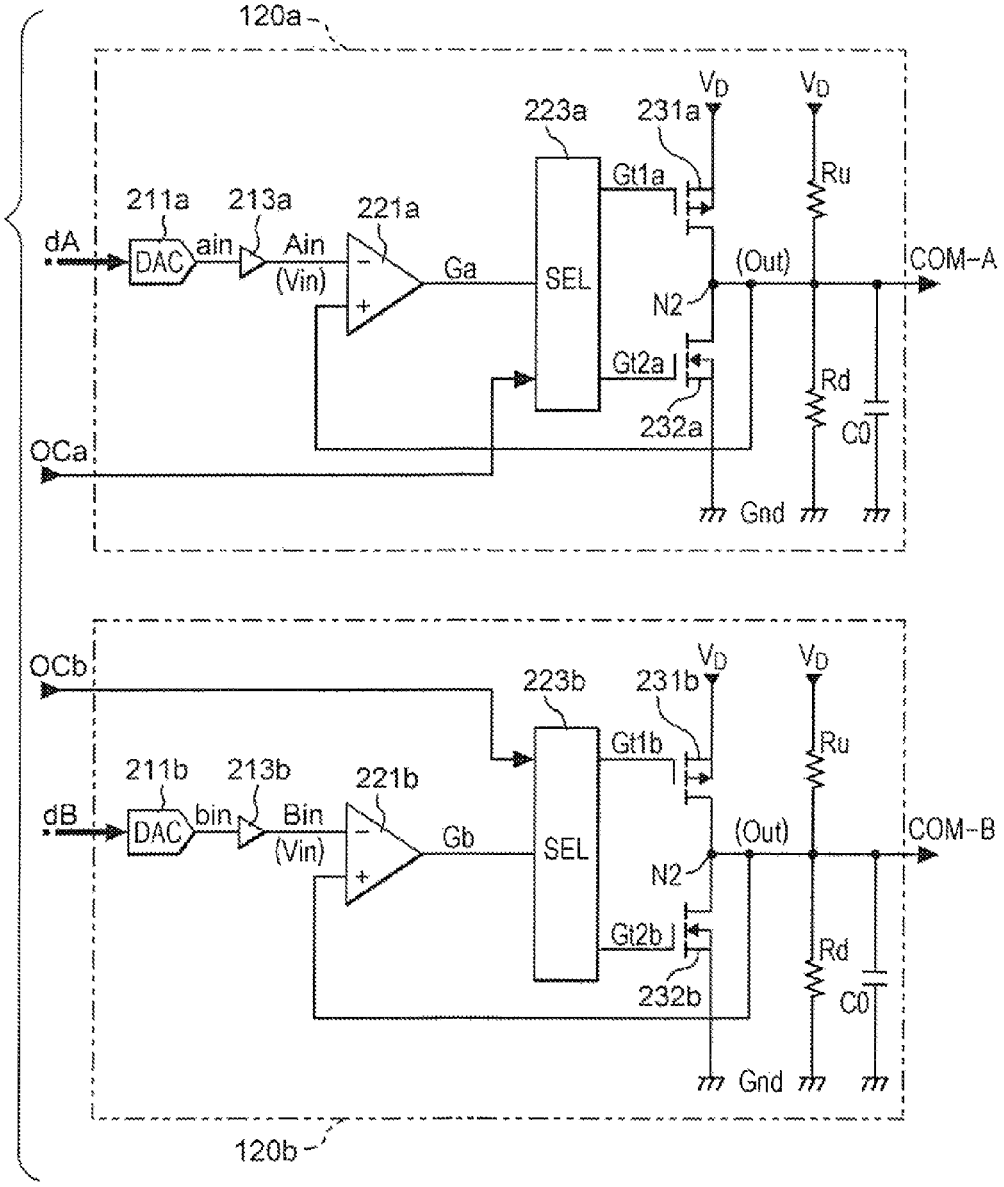
FIG. 16 is a diagram illustrating a drive circuit (comparative example).

FIG. 16 is a diagram illustrating a configuration of a drive circuit according to a comparative example. A difference between the drive circuit (comparative example) illustrated in FIG. 16 and the drive circuit (Example 1) illustrated in FIG. 10 is that the drive circuit illustrated in FIG. 16 does not include the adjustment unit 140, the signal Ga which is output from the differential amplifier 221*a* is directly supplied to the selector 223*a*, and the signal Gb which is output from the differential amplifier 221*b* is directly supplied to the selector 223*b*.

An operation of the drive circuit (comparative example) will be described by using a side which outputs the drive signal COM-A as an example.

Figure 17:
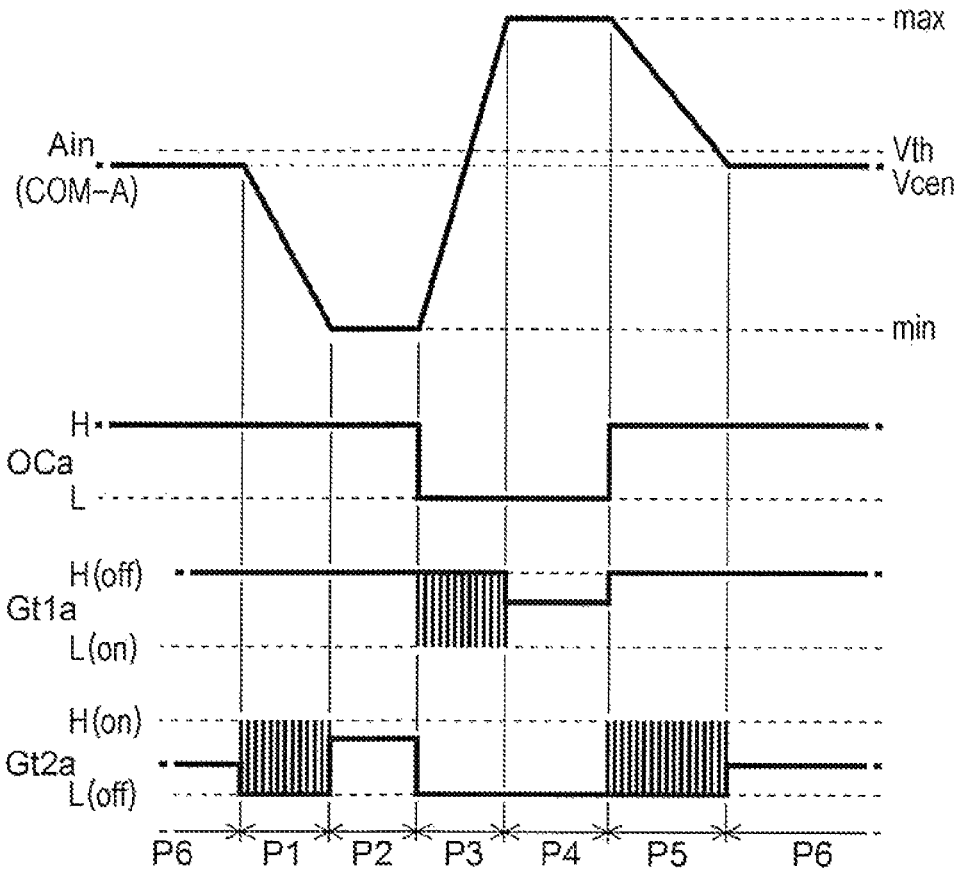
FIG. 17 is a diagram illustrating an operation of the drive circuit (comparative example).

FIG. 17 is a diagram illustrating an operation of the unit circuit 120*a* of the drive circuit according to the comparative example.

In this figure, the signal Ain is a signal with a large amplitude which is obtained by voltage-amplifying the signal ain with a small amplitude, and is a signal before the drive signal COM-A is impedance-converted, and thus, the signal Ain has approximately the same waveform as the drive signal COM-A. In addition, as described above, the drive signal COM-A has a waveform in which the same two trapezoidal waveforms Adp1 and Adp2 are repeated in the print period Ta, and thus, the signal Ain also has the same repeating waveform.

In the figure, a period P1 is a period in which the voltage Vin of the signal Ain decreases from the voltage Vcen to the minimum value min, a period P2 subsequent to the period P1 is a period in which the voltage Vin is constant at the minimum value min, a period P3 subsequent to the period P2 is a period in which the voltage Vin increases from the minimum value min to the maximum value, a period P4 subsequent to the period P3 is a period in which the voltage Vin is constant at the maximum value max, and a period P5 subsequent to the period P4 is a period in which the voltage Vin decreases from the maximum value max to the voltage Vcen.

In relation to each voltage waveform of FIG. 17, a vertical scale denoting a voltage is not necessarily assigned for the sake of convenient description.

First, the period P1 is a voltage decrease period of the drive signal COM-A (Ain). Accordingly, since the signal OCa is in a H level during the period P1, the selector 223*a* selects a H level as the signal Gt1*a*, and selects the output signal Ga of the differential amplifier 221*a* as the signal Gt2*a*.

Since the signal Gt1*a* is in a H level during the period P1, the P-channel transistor 231*a* is turned off.

Meanwhile, first, the voltage Vin of the signal Ain decreases ahead of the voltage Out of the node N2 in the period P1. In other words, the voltage Out becomes a voltage higher than or equal to the voltage Vin. Accordingly, a voltage of the signal Ga which selected as the signal Gt2*a* increases in accordance with the difference: voltage between two voltages, and swings to a H level. If the signal Gt2*a* is in a H level, the transistor 232*a* is turned on, and thus, the voltage Out decreases. Actually, the voltage Out is not decreased to the ground Gnd immediately, and is decreased slowly by the capacitor C0, the piezoelectric element Pzt with capacitance, or the like.

If the voltage Out decreases to be lower than the voltage Vin, the signal Gt2*a* is in a L level, and the transistor 232*a* is turned off, but since the voltage Vin is low, the voltage Out increases to be higher than or equal to the voltage Vin again. Accordingly, the signal Gt2*a* is in a H level, and thereby, the transistor 232*a* is turned on again.

In the period P1, the signal Gt2*a* is alternately switched between a H level and a L level, and thereby, the transistor 232*a* performs an operation of repeating turn-on and turn-off, that is, a switching operation. By the switching operation, control of causing the voltage Out to follow a decrease of the voltage Vin is performed.

The subsequent period P2 is a period in which the drive signal COM-A (Ain) is constant at the minimum value min of a voltage lower than the threshold voltage Vth. Accordingly, the signal OCa is in a H level subsequent to the period P1 in the period P2, and thus, the selector 223*a* selects a H level as the signal Gt1*a* and selects the signal Ga which is output from the differential amplifier 221*a* as the signal Gt2*a*.

The voltage Out is controlled to follow the voltage Vin in the period P1, but content of the control is the switching operation of the transistor 232*a* as described above. Accordingly, there is a case where, immediately after the period P2 starts, that is, immediately after the voltage Vin turns to be constant at the minimum value min, the voltage Out does not coincide with the voltage Vin.

In this case, if the voltage Out is higher than the voltage Vin, the voltage of the signal Gt2*a* also increases, and thus, resistance between a source and a drain of the transistor 232*a* decreases, thereby, decreasing the voltage Out of the node N2. Meanwhile, if the voltage Out is lower than the voltage Vin, the voltage of the signal Gt2*a* also decreases, and thus, the resistance between the source and the drain of the transistor 232*a* increases, thereby, increasing the voltage Out.

Hence, in the period P2, a balance is kept between a direction in which the voltage Out decreases and a direction in which the voltage increases, that is, the voltage Out is balanced to coincide with the voltage Vin (minimum value min). At this time, the transistor 232*a* performs a linear operation, and the signal Gt2*a* is balanced at a voltage in which the voltage Out becomes the voltage Vin.

FIG. 17 illustrates a state where the voltage of the signal Gt2*a* changes briefly from the period P1 to the period P2 thereby becoming immediately constant.

The period P3 is a voltage increase period of the drive signal COM-A (Ain). Accordingly, the signal OCa is in a L level during the period P3, and thus, the selector 223*a* selects the signal Ga as the signal Gt1*a*, and selects a L level as the signal at Gt2*a*. The signal Gt2*a* is in a L level during the period P3, and thus, the N-channel transistor 232*a* is turned off.

Meanwhile, first, the voltage Vin increases ahead of the voltage Out during the period P3. In other words, the voltage Out decreases to be lower than the voltage Vin. Accordingly, the voltage of the signal Ga which is selected as the signal Gt1*a* decreases in accordance with the difference voltage between two voltages, and approximately swings to a L level. If the signal Gt1*a* is in a L level, the transistor 231*a* is turned on, and thus, the voltage Out increases. Actually, the voltage Out is not increased to the voltage $V_D$ immediately, and is increased slowly by the capacitor C0, the piezoelectric element Pzt with capacitance, or the like.

If the voltage Out is a voltage higher than or equal to the voltage Vin, the signal Gt2*a* is in a H level, and the transistor 231*a* is turned off. If the transistor 231*a* is turned off, an increase of the voltage Out is stopped, but since the voltage Vin increases, the voltage Out decreases to be lower than the voltage Vin again. Accordingly, the signal Gt1*a* is in a L level, and the transistor 231*a* is turned on again.

The signal Gt1*a* is alternately switched between a H level and a L level in the period P3, and thereby, the transistor 231*a* performs a switching operation. By the switching operation, control of causing the voltage Out to follow an increase of the voltage Vin is performed.

The period P4 is a period in which the drive signal COM-A (Ain) is constant at a voltage higher than or equal to the threshold voltage Vth. Accordingly, during the period P2, the signal OCa is in a L level subsequent to the period P3, and thus, the selector 223*a* selects the signal Ga which is output from the differential amplifier 221*a* as the signal Gt1*a*, and selects a L level as the signal Gt2*a*.

The voltage Out is controlled to follow the voltage Vin during the period P3, but content of the control is the switching operation of the transistor 231*a* as described above, and thus, there is a case where, immediately after the voltage Vin turns to be constant at the maximum value max in the period P4, the voltage Out does not coincide with the voltage Vin of the signal Ain.

In this case, if the voltage Out is higher than the voltage Vin, the voltage of the signal Gt1*a* also increases, and thus, resistance between a source and a drain of the transistor 231*a* increases, thereby, decreasing the voltage Out of the node N2. Meanwhile, if the voltage Out is lower than the voltage Vin, the voltage of the signal Gt1*a* also decreases, and thus, the resistance between the source and the drain of the transistor 231*a* decreases, thereby, increasing the voltage Out.

Hence, in the period P4, a balance is kept between a direction in which the voltage Out decreases and a direction in which the voltage increases, that is, the voltage Out is balanced to coincide with the voltage Vin (maximum value max). At this time, the transistor 232*a* performs a linear operation, and the signal Gt1*a* is balanced at a voltage in which the voltage Out becomes the voltage Vin.

FIG. 17 illustrates a state where the voltage of the signal Gt1*a* changes briefly from the period P3 to the period P4 thereby becoming immediately constant.

The period P5 is a voltage decrease period of the drive signal COM-A (Ain). Accordingly, an operation in the period P5 is the same as in the period P1. That is, the signal Gt2*a* is alternately switched between a H level and a L level, and thereby, the transistor 232*a* performs a switching operation, and control of causing the voltage Out of the node N2 to follow a decrease of the voltage Vin is performed.

A period P6 subsequent to the period P5 is a period in which the drive signal COM-A (Ain) is constant at the voltage Vcen lower than the threshold voltage Vth. Accordingly, the signal OCa is in a H level subsequent to the period P5 during the period P6, and thus, the selector 223*a* selects a H level as the signal Gt1*a* and selects the signal Ga as the signal Gt2*a*.

The control of causing the voltage Out to follow the voltage Vin of the signal Ain is performed in the period P5, but there is a case where immediately after the voltage Vin turns to be constant at the voltage Vcen during the period P6, the voltage Out does not coincide with the voltage Vin of the signal Ain. In this case, a balance is kept such that the voltage Out coincides with the voltage Vin (Vcen), in the same manner immediately after being turned to the period P2. At this time, the transistor 232*a* performs a linear operation, and the signal Gt2*a* is balanced at a voltage in which the voltage Out becomes the voltage Vin (Vcen).

FIG. 17 illustrates a state where the voltage of the signal Gt2*a* changes briefly from the period to the period P6 thereby being immediately balanced.

According to the unit circuit 120*a* illustrated in FIG. 10, the control of causing the voltage Out of the drive signal COM-A to follow the voltage Vin of the signal Ain is performed by the following operation for each of the periods P1 to P6.

That is, the controls of causing the voltage Out to follow the voltage Vin are performed, by the switching operation of the transistor 232*a* in the periods P1 and P5 in which the voltage Vin decreases, by the linear operation of the transistor 232*a* in the period P2 and P6 in which the voltage Vin is constant at a value lower than the threshold voltage Vth, by the switching operation of the transistor 231*a* in the period P3 in which the voltage Vin increases, and by the linear operation of the transistor 231*a* in the period P4 in which the voltage Vin is constant at a value equal to or higher than the threshold voltage Vth, respectively.

Description is made in which, in the unit circuit 120*a*, the transistor 231*a* performs a switching operation in the period P3 in which the voltage Vout (the voltage Vin of the signal Ain) of the drive signal COM-A increases, and the transistor 232*a* performs a switching operation in the periods P1 and P5 in which the voltage Vout decreases. However, in a case where the number of the piezoelectric elements Pzt to be coupled is large, a linear operation can also be performed in a relationship of a time constant which is determined by ON-resistance of a transistor and a load capacitance.

In the same manner, description is made in which, in the unit circuit 120*a*, the transistor 231*a* performs a linear operation in the period P4 in which the voltage Vout is constant at a voltage higher than or equal to the threshold voltage Vth, and the transistor 232*a* performs a linear operation in the periods P2 and P6 in which the voltage Vout is constant at a voltage lower than the threshold voltage Vth. However, a switching operation can also be performed in the same reason as above.

Here, pull-up and pull-down of the node N2 will be described.

A case where pull-up is required is a case where the transistor 232*a* performs a linear operation in the periods P2 and P6 in which the signal Ain (the drive signal COM-A) is constant at a voltage lower than the threshold value Vth. In this case, the transistor 231*a* on a high side is turned off, and thus, it is necessary for the node N2 to be pulled up on a high side such that the voltage Out of the node N2 follows the signal Ain by the transistor 232*a*.

Meanwhile, a case where pull-down is required is a case where the transistor 231*a* performs a linear operation in the period P4 in which the signal Ain (the drive signal COM-A) is constant at a voltage equal to or higher than the threshold value Vth. In this case, the transistor 232*a* on a low side is turned off, and thus, it is necessary for the node N2 to be pulled down on a low side such that the voltage Out of the node N2 follows the signal Ain by the transistor 231*a* on a high side.

Here, the unit circuit 120*a* is described, but the unit circuit 120*b* which generates the drive signal COM-B from the data dB also performs the same operation as the unit circuit 120*a*, except that waveforms of input and output signals are different.

However, in the drive circuit (comparative example), the following problems are pointed out. As described above, when the unit circuits 120*a*, and 120*b* perform a switching operation, if transistors with the same size simultaneously are turned on, noise according to the turn-on is doubled to propagate to the periphery, and thereby, a malfunction of the drive circuit or waveform disturbance occurs.

For example, while a switching operation is performed in a case where voltages of the drive signals COM-A and COM-B increase together, when the signals Ga and Gb are changed from a H level to a L level accidentally and simultaneously and thereby the transistors 231*a* and 231*b* are simultaneously turned on, spike noise is generated in accordance with a level change of the signals Ga and Gb in the same direction. In addition, since a voltage of the node N2 in the unit circuit 120*a* and a voltage of the node N2 in the unit circuit 120*b* increase simultaneously, the spike noise is generated in the same manner.

In contrast to this, while a switching operation is performed in a case where voltages of the drive signals COM-A and COM-B decrease together, when the signals Ga and Gb are changed from a L level to a H level accidentally and simultaneously and thereby the transistors 232*a* and 232*b* are simultaneously turned on, the spike noise is generated in accordance with a level change of the signals Ga and Gb in the same direction. In addition, since the voltage of the node N2 in the unit circuit 120*a* and the voltage of the node N2 in the unit circuit 120*b* decrease simultaneously, the spike noise is generated in the same manner.

It is considered that simultaneous turn-on of transistor with different sizes is not problems, compared with the simultaneous turn-on of the transistors with the same size. This is because one of the voltage of the node N2 in the unit circuit 120*a* and the voltage of the node N2 in the unit circuit 120*b* increases and the other voltage decreases, and thereby, spike noises in an opposite direction cancel each other.

In order to reduce effects of the spike noise, the drive circuit (Example 1), the adjustment unit 140 is provided in the drive circuit (comparative example), as illustrated in FIG. 10.

In the unit circuit 120*a*, the signal OCa defines an operation (switching operation, linear operation) of one of the transistors 231*a* and 232*a*, and in the unit circuit 120*b*, the signal OCb defines an operation of one of the transistors 231*b* and 232*b*. Accordingly, it shows that, if logic levels of the signals OCa and OCb are the same, the transistors with the same size in the unit circuits 120*a* and 120*b* can be simultaneously turned on.

Hence, the adjustment unit 140 has a configuration in which, in a case where logic levels of the signals OCa and OCb are the same, when levels of the signals Ga and Gb change simultaneously in the same direction, one of the signals Ga and Gb is delayed by time ds.

The embodiment has a configuration in which the signal Gb is delayed by the time ds by the following reasons. That is, the reason why the embodiment has the configuration in which the signal Gb is delayed is that, although a slope of the trapezoidal waveform of the drive signal COM-B which is generated by the unit circuit 120*b* is slighter than a slope of the trapezoidal waveform of the drive signal COM-A which is generated by the unit circuit 120*a*, and thereby, switching is slightly delayed and following of the voltage Out to the voltage Bin is delayed, the signal Gb is not affected thereby.

In other words, a configuration may be provided in which the signal Ga is delayed if the slope of the trapezoidal waveform of the drive signal COM-B is steeper than the slope of the trapezoidal waveform of the drive signal COM-A. In addition, a configuration may be provided in which the slope of the waveform of the drive signal COM-A and the slope of the waveform of the drive signal COM-B are detected from the signals Ain and Bin (data dA and dB) or the like in real time to be compared with each other, and one of the signals Ga and Gb corresponding to the slighter slope is delayed.

In addition, strictly speaking, the "simultaneous" of the aforementioned simultaneous turn-on does not mean the same timing, and means that it is within a threshold time. That is, it means that a level change of the other signal being performed within the threshold time in the same direction with respect to a level change of one of the signals Ga and Gb is allowed.

As a result, the adjustment unit 140 in the drive circuit (Example 1) outputs the signal Ga as the signal Gta as it is, and outputs the signal Gb as the signal Gtb by delaying by the time ds, when the level changes of the signals Ga and Gb are simultaneously performed in the same direction, if logic levels of the signals OCa and OCb are the same as each other. In a case where the logic levels of the signals OCa and OCb are difference from each other, or in a case where the logic levels of the signals OCa and OCb are the same as each other, when the level changes of the signals Ga and Gb are simultaneously performed in different directions, the adjustment unit 140 outputs the signal Ga as the signal Gta as it is and outputs the signal Gb as the signal Gtb as it is.

Figure 11:
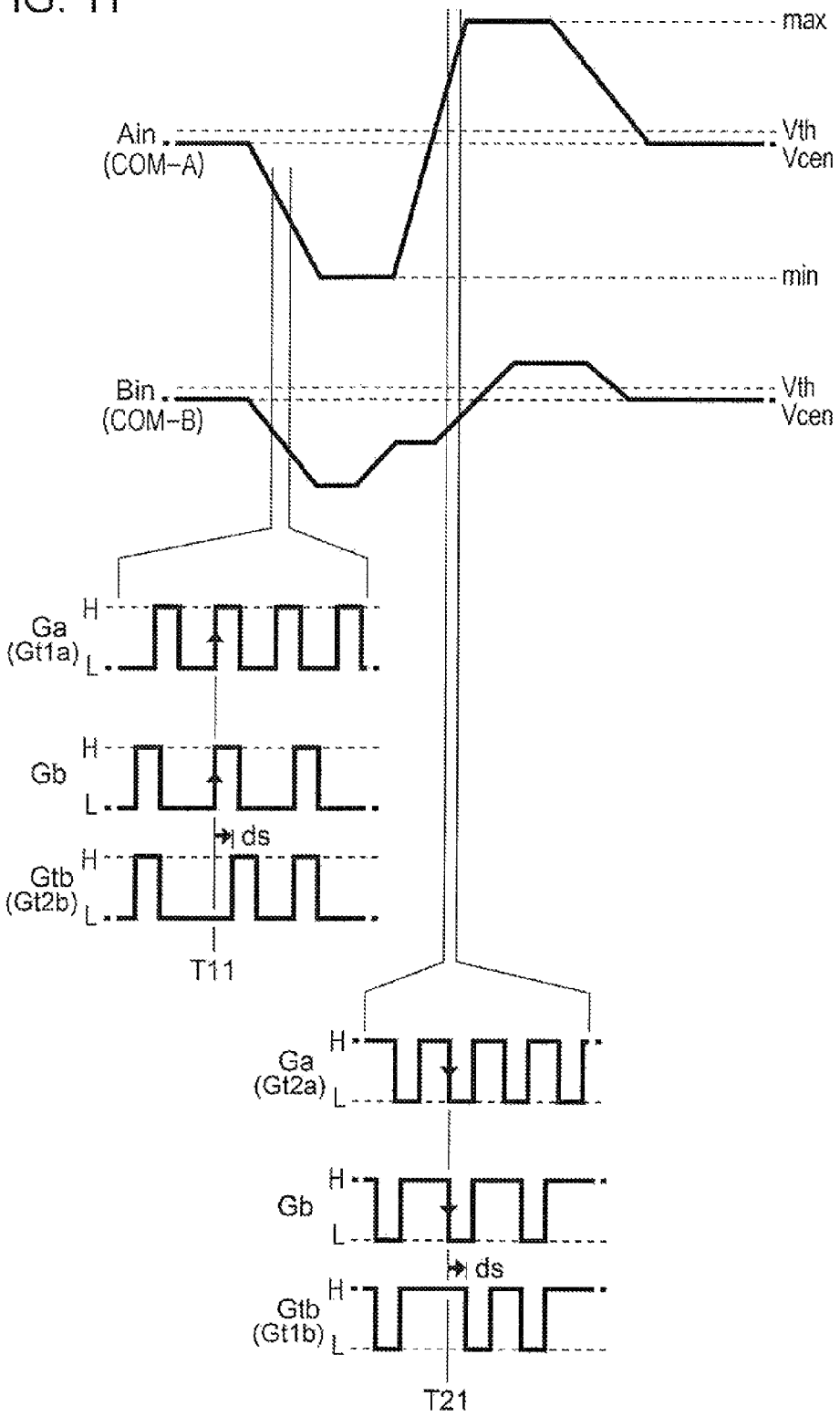
FIG. 11 is a diagram illustrating an operation of the drive circuit (Example 1).

FIG. 11 is a diagram illustrating the operation of the drive circuit (Example 1).

In a case where the voltages of the drive signal COM-A (signal Ain) and the drive signal COM-B (signal Bin) decrease together, the transistor 232*a* in the unit circuit 120*a* performs a switching operation, and the transistor 232*b* in the unit circuit 120*b* performs a switching operation. Accordingly, there is a case where the signals Ga and Gb changes together from a L level to a H level in the same manner as in timing T11 of FIG. 11.

In this case, the transistors 232*a* and 232*b* in the drive circuit (comparative example) illustrated in FIG. 16 are turned on together, and thus, the spike noise is doubled to propagate to the periphery and a malfunction of the drive circuit or waveform disturbance occurs, as described above.

In contrast to this, according to the drive circuit (Example 1), the signal Gb is delayed by the time ds from the timing T11 to be output as the signal Gtb as illustrated in FIG. 11, and thus, the transistors 232*a* and 232*b* are not turned on simultaneously.

Meanwhile, in a case where the voltages of the drive signal COM-A (signal Ain) and the drive signal COM-B (signal Bin) increase together, the transistor 231*a* in the unit circuit 120*a* performs a switching operation, and the transistor 231*b* in the unit circuit 120*b* performs a switching operation. Accordingly, there is a case where the signals Ga and Gb changes together from a H level to a L level in the same manner as in timing T21 of FIG. 11.

In this case, in the drive circuit (comparative example), the transistors 231*a* and 231*b* are turned on together, and thus, as described above, the spike noise is generated and a malfunction of the drive circuit or waveform disturbance occurs, but according to the drive circuit (Example 1), the signal Gb is delayed by the time ds from the timing T21 to be output as the signal Gtb, and thus, the transistors 231*a* and 231*b* are not turned on simultaneously.

Accordingly, according to the drive circuit (Example 1), it is possible to prevent spike noise caused by simultaneous turn-on of the transistors from being generated, and to reduce occurrence of a malfunction of the drive circuit or waveform disturbance.

The signal OCa (OCb) can be generated by another circuit without being output from the control unit 110, by analyzing the data dA (dB) as follows.

For example, In relation to the data dA (dB), discrete values (data) which are temporally adjacent to each other, compared to each other, and if the discrete values are equal, the values are in a voltage-constant period, and by determining the discrete values in the constant period, it is possible to determine whether or not a voltage in the constant period is higher than or equal to the threshold voltage Vth. In addition, if, when voltage conversion is performed, the discrete value which is temporally later is larger than the discrete value which is temporally prior among the discrete values the value is in a voltage increase period, and if, when voltage conversion is performed, the discrete value which is temporally later is smaller than the discrete value which is temporally prior the value is in a voltage decrease period.

A signal which is obtained by performing analog conversion may be analyzed in the same manner, but not for the data dA (dB).

In addition, the unit circuit 120*a* may include a diode for blocking a current flowing from the node N2 toward a drain terminal of the transistor 231*a* and a diode for blocking a current flowing from a drain terminal of the transistor 232*a* toward the node N2. This is the same for the unit circuit 120*b*.

Hence, in the unit circuit 120*a* of the drive circuit (Example 1), a pair of transistors 231*a* and 232*a* operate with a power supply voltage ($V_D$–Gnd) in accordance with an amplitude of the drive signal COM-A. As described above, since the voltage of the drive signal COM-A is approximately maximum 40 volts, the selector 223*a* and the differential amplifier 221*a* require high breakdown voltages. The reason is that the signal Gt1*a* is needed to be supplied to the gate terminal of the transistor 231*a* and the signal Gt2*a* is needs to be supplied to the gate terminal of the transistor 232*a*.

Since the unit circuit 120*b* has the same configuration as above, the selector 223*b* and the differential amplifier 221*b* require high breakdown voltages in the same manner as above.

Hence, a drive circuit (Example 2) having a different configuration in which the aforementioned problem is solved will be described hereinafter. The drive circuit (Example 2) is applied to the configuration of the printing apparatus illustrated in FIG. 4 as it is.

Figure 12:
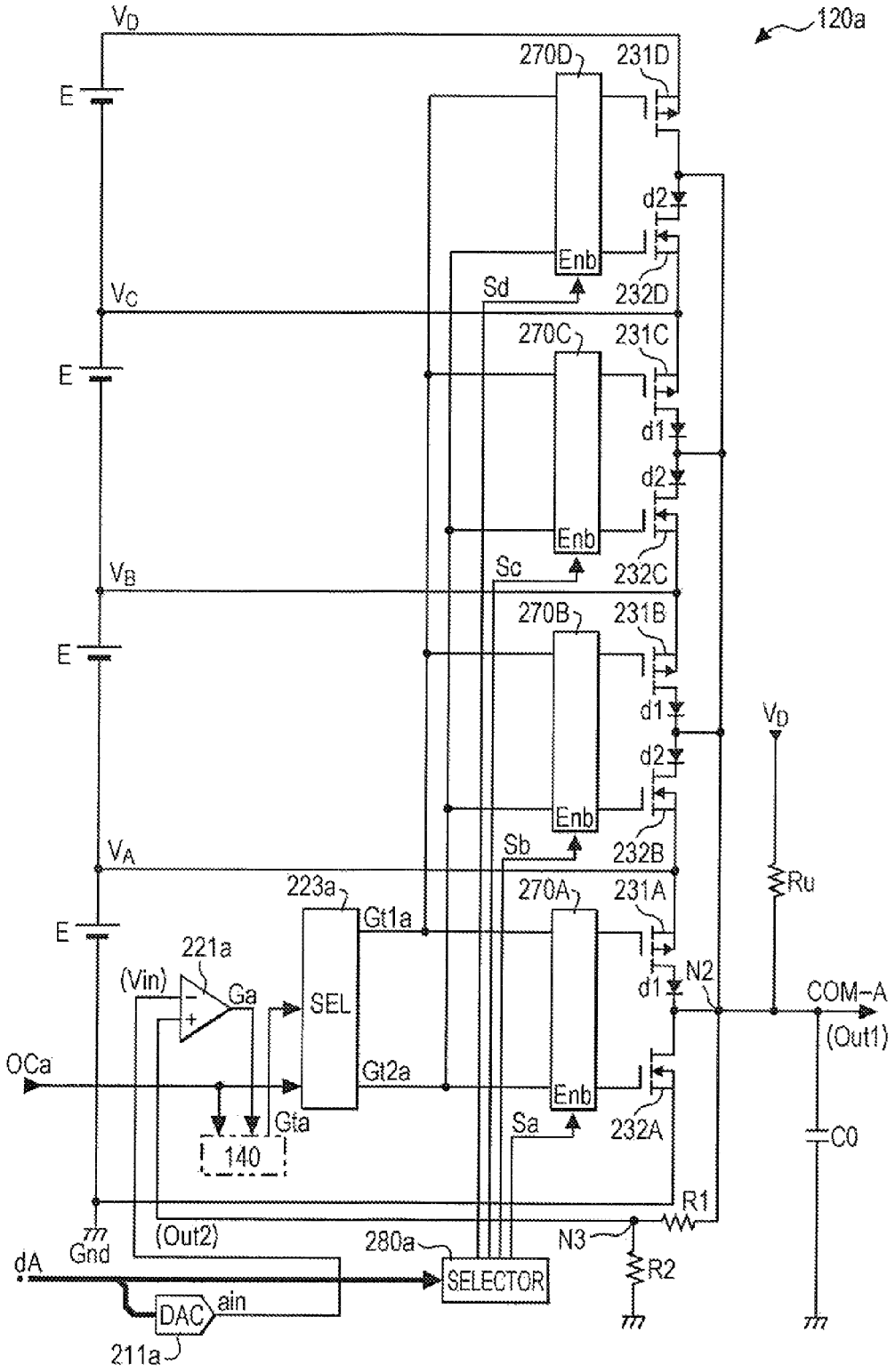
FIG. 12 is a diagram illustrating a main portion of a drive circuit (Example 2) which can be applied to the printing apparatus.

FIG. 12 is a diagram illustrating a configuration of the unit circuit 120*a* in the drive circuit (Example 2). While not illustrated in this figure, the unit circuit 120*b* also has the same configuration as the unit circuit 120*a*.

As illustrated in FIG. 12, the unit circuit 120*a* includes gate selectors 270A, 270B, 270C, and 270D, a selector 280*a*, four pairs of transistors, resistance elements Ru, R1 and R2, and the capacitor C0, in addition to four reference power supplies E, the differential amplifier 221*a*, and the selector 223*a*.

In the unit circuit 120*a* of the drive circuit (Example 2), voltages E, 2E, 3E, and 4E are respectively output as voltages $V_A$, $V_B$, $V_C$ and $V_D$ by the reference power supplies of four stages which are coupled in series, each reference power supply outputs a voltage E.

Figure 13:
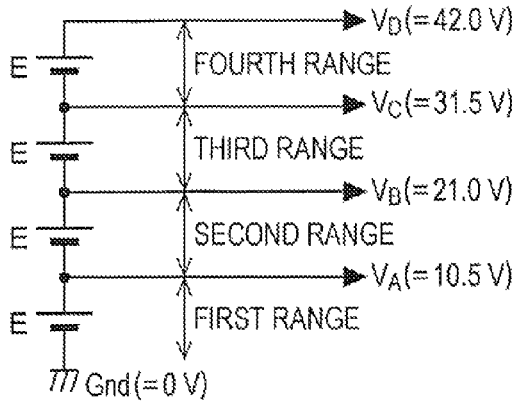
FIG. 13 is a diagram illustrating an operation of the drive circuit (Example 2).

FIG. 13 is a diagram illustrating voltages $V_A$, $V_B$, $V_C$, and $V_D$.

As illustrated in the figure, when the voltage E is set to, for example, 10.5 V, $V_A$, $V_B$, $V_C$, and $V_D$ are respectively 10.5 V, 21.0 V, 31.5 V, and 42.0 V. In this embodiment, the following voltage ranges are defined in accordance with the voltages $V_A$, $V_B$, $V_C$, and $V_D$. That is, a range higher than or equal to the ground Gnd of zero volts and lower than the voltage $V_A$ is defined as a first range, a range higher than or equal to the voltage $V_A$ and lower than the voltage $V_B$ is defined as a second range, a range higher than or equal to the voltage $V_B$ and lower than the voltage $V_C$ is defined as a third range, and a range higher than or equal to the voltage $V_C$ and lower than the voltage $V_D$ is defined as a fourth range.

Returning to the description of FIG. 12, the signal ain with a small amplitude is supplied to a negative input terminal (–) of the differential amplifier 221*a*, and a voltage Out2 of a node N3 is applied to a positive input terminal (+) thereof. That is, the unit circuit 120*a* of the drive circuit (Example 2) does not have the voltage amplifier 213*a* (refer to FIG. 10), and the signal ain with a small amplitude which is an output of the DAC 211*a* is directly supplied to the negative input terminal (–) of the differential amplifier 221*a*. Accordingly, in this example, a voltage of the signal ain becomes Vin, and the differential amplifier 221*a* amplifies a difference voltage which is obtained by subtracting the voltage Vin from the voltage Out2, and supplies a signal of the amplified voltage to the adjustment unit 140 as the signal Ga.

In the differential amplifier 221*a* in the drive circuit (Example 2), a high side of the power supply is referred to as $V_A$, in a different manner from the drive circuit (Example 1). Accordingly, the output voltage of the differential amplifier 221*a* is within a range from the ground Gnd to the voltage $V_A$. In addition, the selector 223*a* of the unit circuit 120*a* in the drive circuit (Example 2) is the same as in the drive circuit (Example 1), and outputs the signals Gt1*a* and Gt2*a*, based on the signal Ota from the adjustment unit 140 and the signal OCa.

The selector 280*a* discriminates a range of the voltage Vin of the signal ain from the data dA which is supplied from the control unit 110 (refer to FIG. 4), and outputs select signals Sa, Sb, Sc, and Sd in accordance with the discrimination result as follows.

In detail, in a case where the voltage Vin of the signal ain which is defined by the data dA is discriminated to be higher than or equal to 0 V and lower than 1.05 V, that is, in a case where a voltage at the time of amplifying the voltage Vin 10 times is included in the first range, the selector 280*a* sets only the select signal Sa to a H level, and sets the other select signals Sb, Sc, and Sd to a L level. In addition, in a case, where the voltage Vin which is defined by the data dA is discriminated to foe higher than or equal to 1.05 V and lower than 2.10 V, that is, in a case where a voltage at the time of amplifying the voltage Vin 10 times is included in the second range, the selector 280*a* sets only the select signal Sb to a H level, and sets the other select signals Sa, Sc, and Sd to a L level. In the same manner, in a case where the voltage Vin which is defined by the data dA is discriminated to be higher than or equal to 2.10 V and lower than 3.15 V, that is, in a case where a voltage at the time of amplifying the voltage Vin 10 times is included in the third range, the selector 280*a* sets only the select signal Sc to a H level, and sets the other select signals Sa, Sb, and Sd to a L level. In case where the voltage Vin is discriminated to be higher than or equal to 3.15 V and lower than 4.20 V, that is, in a case where a voltage at the time or amplifying the voltage Vin 10 times is included in the fourth range, the selector 280*a* sets only the select signal Sd to a H level, and sets the other select signals Sa, Sb, and Sc to a L level.

Here, for the sake of convenient description, four pairs of transistors will be described.

In the example, the four pairs of transistors are configured by a pair of transistors 231A and 232A, a pair of transistors 231B and 232B, a pair of transistors 231C and 232C, and a pair of transistors 231D and 232D.

Among the respective pairs of transistors, the transistors 231A, 231B, 231C, an 231D on a high side are, for example, P-channel field effect transistors, and the transistors 232A, 232B, 232C, and 232D on a low side are, for example, N-channel field effect transistors.

In the transistor 231A, the voltage $V_A$ is applied to a source terminal thereof, and a drain terminal thereof is coupled to the node N2. In the transistor 232A, a source terminal thereof is coupled to the ground Gnd, and a drain terminal thereof is coupled to the node N2 in common.

In the same manner, in the transistor 231B (231C, 231D), the voltage $V_B$ ($V_C$, $V_D$) is applied to a source terminal thereof, and a drain terminal thereof is coupled to the node N2. In the transistor 232B (232C, 232D), the voltage $V_A$ ($V_B$, $V_C$) is applied to a source terminal thereof, and a drain terminal thereof is coupled to the node N2 in common.

While detailed description will be made below, when the gate selector 270A is enabled, the transistors 231A and 232A output drive signals by using the voltage and the ground Gnd as power supply voltages, and when the gate selector 270B is enabled, the transistors 231B and 232B output drive signals by using the voltage $V_B$ and the voltage $V_A$ as power supply voltages. In the same manner, when the gate selector 270C is enabled, the transistors 231C and 232C output drive signals by using the voltage $V_C$ and the voltage $V_B$ as power supply voltages, and when the gate selector 270D is enabled, the transistors 231D and 232D output drive signals by using the voltage $V_D$ and the voltages $V_C$ as power supply voltages.

In this configuration, the power supply voltage of the transistors 231A and 232A, the power supply voltage of the transistors 231B and 232B, the power supply voltage of the transistors 231C and 232C, and the power supply voltage of the transistors 231D and 232D are all 10.5 V.

When the select signal Sa supplied to an input terminal Enb is enabled to a H level, the gate selector 270A level-shifts the signals Gt1*a* and Gt2*a* which are output from the selector 223*a*, and supplies the shifted signals to gate terminals of the transistors 231A and 232A, respectively. In detail, when being enabled, the gate selector 270A level-shifts a range from a minimum voltage to a maximum voltage of the signal Gt1*a* into the first range from the ground Gnd to the voltage $V_A$, supplies the shifted voltage to the gate terminal of the transistor 231A, level-shifts a range from a minimum voltage to a maximum voltage of the signal Gt2*a* into the first range, and supplies the shifted voltage to the gate terminal of the transistor 232A.

If description is made to be limited to the gate selector 270A, a range from minimum voltages to maximum voltages of the signals Gt1*a* and Gt2*a* coincides with the first range, and thus, when being enabled, the signals Gt1*a* and Gt2*a* are supplied to the gate terminals of the transistors 231A and 232A as it is.

When being enabled, the gate selector 270B level-shifts a range from a minimum voltage to a maximum voltage of the signal Gt1*a* into the second range from the voltage $V_A$ to the voltage $V_B$, supplies the shifted voltage to the gate terminal of the transistor 231B, level-shifts a range from a minimum voltage to a maximum voltage of the signal Gt2*a* into the second range, and supplies the shifted voltage to the gate terminal of the transistor 232B. That is, if description is made to be limited to the gate selector 270B, when being enabled, the signals Gt1*a* and Gt2*a* to which 10.5 V is added are supplied to the gate terminals of the transistors 231B and 232B.

In the same manner, when being enabled, the gate selector 270C level-shifts a range from a minimum voltage to a maximum voltage of the signal Gt1*a* into the third range from the voltage $V_B$ to the voltage $V_C$, supplies the shifted voltage to the gate terminal of the transistor 231C, level-shifts a range from a minimum voltage to a maximum voltage of the signal Gt2*a* into the third range, and supplies the shifted voltage to the gate terminal of the transistor 232C. That is, if description is made to be limited to the gate selector 270C, when being enabled, the signals Gt1*a* and Gt2*a* to which 21.0 V is added are supplied to the gate terminals of the transistors 231C and 232C.

In the same manner, when being enabled, the gate selector 270D level-shifts a range from a minimum voltage to a maximum voltage of the signal Gt1*a* into the fourth range from the voltage $V_C$ to the voltage $V_D$, supplies the shifted voltage to the gate terminal of the transistor 231D, level-shifts a range from a minimum voltage to a maximum voltage of the signal Gt2*a* into the fourth range, and supplies the shifted voltage to the gate terminal of the transistor 232D. That is, if description is made to be limited to the gate selector 270D, when being enabled, the signals Gt1*a* and Gt2*a* to which 31.5 V is added are supplied to the gate terminals of the transistors 231D and 232D.

When the select signals supplied to the input terminals Enb are disabled to a L level, the gate selectors 270A, 270B, 270C, and 270D respectively output signals which turn off two transistors corresponding thereto. That is, if being disabled, the gate selectors 270A, 270B, 270C, and 270D forcibly convert the signal Gt1*a* to a H level, and forcibly convert the signal Gt2*a* to a L level.

Here, the H level and the L level are respectively a high-side voltage and a low-side voltage of the power supply voltage of each of the gate selectors 270A, 270B, 270C, and 270D. For example, the gate selector 270B vises the voltage $V_B$ and the voltage $V_A$ as a power supply voltage thereof, and thus, the voltage $V_B$ on a high side is a H level, and a voltage $V_A$ on a low side is a L level.

The node N2 is fed back to the positive input terminal (+) of the differential amplifier 221*a* through the resistance element R1. In this example, for the sake of convenience, the positive input terminal (+) of the differential amplifier 221*a* is referred to as the node N3, and a voltage of the node N3 is referred to as Out2.

The node N3 is coupled to the ground Gnd through the resistance element R2. Accordingly, the voltage Out2 of the node N3 is obtained by dividing a voltage of the voltage Out by a ratio which is defined by resistance values of the resistance elements R1 and R2, that is, R2/(R1+R2). In the embodiment, a drop ratio is set to 1/10. In other words the voltage Out2 is 1/10 of the voltage Out.

In addition, in the same manner as in the drive circuit (Example 1) illustrated in FIG. 10, the node N2 is pulled up to the voltage $V_D$ through the resistance element Ru in the drive circuit (Example 2). Meanwhile, pull-down of the node N2 is performed by the resistance elements R1 and R2 which drops the voltage Out of the node N2 and feeds back the dropped voltage to the differential amplifier 221*a*. That is, the resistance elements R1 and R2 of the drive circuit (Example 2) have both a function of pulling down the node N2 and a function of dropping the voltage Out to feed back to the differential amplifier 221*a*.

Diodes d1 and d2 are used for blocking reverse currents. A forward direction of the diode d1 is a direction toward the node N2 from the drain terminals of the transistors 231A, 231B, and 231C, a forward direction of the diode d2 is a direction toward the drain terminals of the transistors 231B, 231C, and 231D from the node N2.

The voltage Out of the node N2 is not higher than the voltage $V_D$, and thus, it is hot necessary to consider a reverse current. Accordingly, the diode d1 is not provided for the transistor 231D. In the same manner, the voltage Out of the node N2 is not lower than the ground Gnd of zero volts, and thus, the diode d2 is not provided for the transistor 232A.

Here, the unit circuit 120*a* will be described, but unit circuit 120*b* is the same as the unit circuit 120*a* except for input and output signals.

Next, an operation of the unit circuit 120*a* of the drive circuit (Example 2) will be described.

Figure 14:
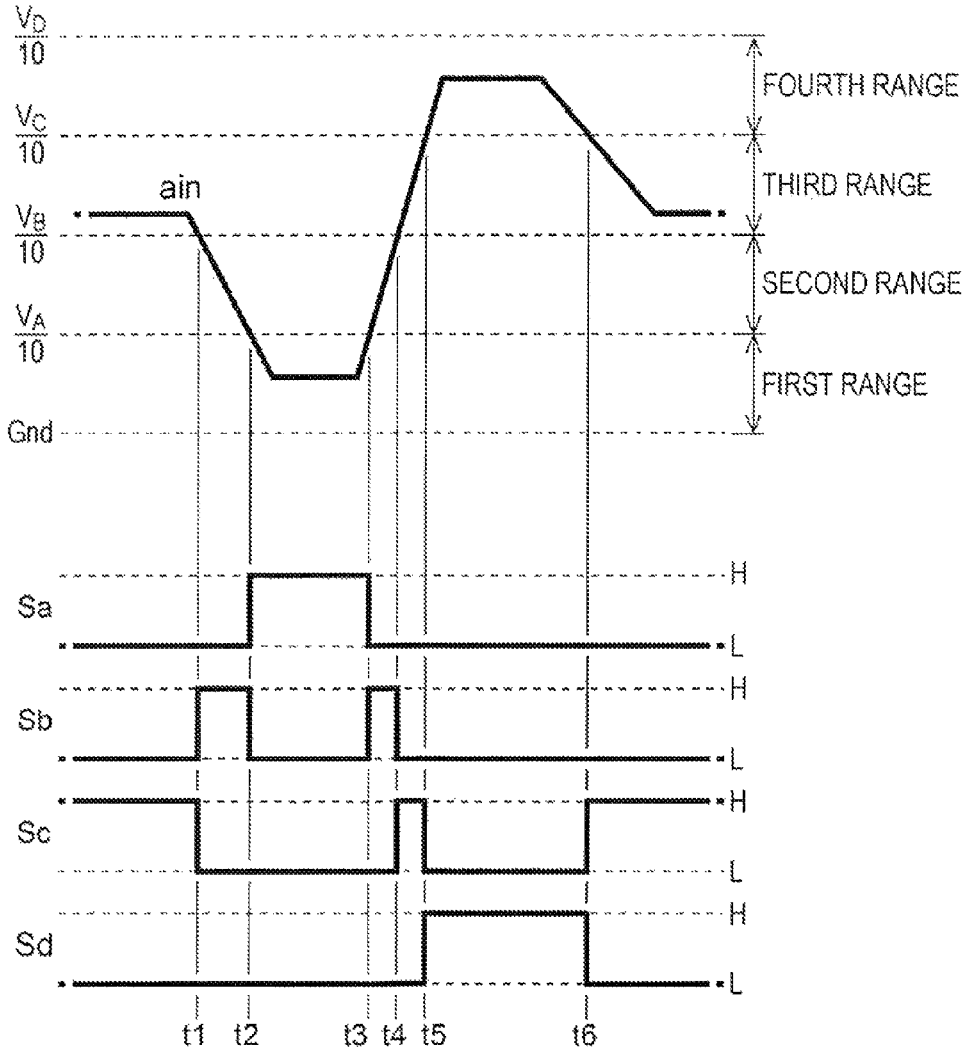
FIG. 14 is a diagram illustrating the operation or the drive circuit (Example 2).

FIG. 14 is a diagram illustrating the operation of the unit circuit 120*a* of the drive circuit (Example 2). As illustrated in the figure, the signal ain is similar to the drive signal COM-A, but the signal ain has a small amplitude immediately after being converted by analog conversion of the DAC 211*a*, and is 1/10 of the voltage of the drive signal COM-A.

Accordingly, in a case where the first range to the fourth range which are defined by the voltages $V_A$, $V_B$, $V_C$, and $V_D$ are converted into a voltage range of the signal ain, the ranges are defined by the voltages $V_A/10$, $V_B/10$, $V_C/10$, and $V_D/10$. In detail, in the signal ain, a range higher than or equal to 0 V and lower than $V_A/10$ (=1.05 V) corresponds to the first range, a range higher than or equal to $V_A/10$ and lower than $V_B/10$ (=2.10 V) corresponds to the second range, a range higher than or equal to $V_B/10$ and lower than $V_C/10$ (=3.15 V) corresponds to the third range, and a range higher than or equal to $V_C/10$ and lower than $V_D/10$ (=4.20 V) corresponds to the fourth range.

First, in a case where it is discriminated from the data dA that the voltage Vin is in the third range in a period prior to timing t1, the selector 280*a* sets only the select signal Sc to a H level, and sets the other select signals Sa, Sb, and Sd to a L level, and thereby the gate selector 270C is enabled, and the other gate selectors 270A, 270B, and 270D are disabled. Hence, in this case, the transistors 231C and 232C output the drive signal COM-A by using the voltages $V_C$ and $V_B$ as power supply voltages.

Next, when the voltage Vin is in the second range during a period from timing t1 to timing t2, the selector 280*a* sets only the select signal Sb to a H level, and sets the other select signals Sa, Sc, and Sd to a L level, and thereby the gate selector 270B is enabled, and the other gate selectors 270A, 270C, and 270D are disabled. Hence, in this case, the transistors 231B and 232B output the drive signal COM-A by using the voltages $V_B$ and $V_A$ as power supply voltages.

When the voltage Vin is in the first range during a period from timing t2 to timing t3, the selector 280*a* sets only the select signal Sa to a H level, and as a result, only the gate selector 270A is enabled, and thereby the transistors 231A and 232A output the drive signal COM-A by using the voltages $V_A$ and the ground Gnd as power supply voltages.

The subsequent operations will be briefly described. Since only the gate selector 270B is enabled during a period from timing t3 to timing t4, the transistors 231B and 232B use the voltages $V_B$ and $V_A$ as power supply voltages. Since only the gate selector 270C is enabled during a period from timing t4 to timing t5, the transistors 231C and 232C use the voltages $V_C$ and $V_B$ as power supply voltages. Since only the gate selector 270D is enabled during a period from timing t5 to timing t6, the transistors 231D and 232D use the voltages $V_D$ and $V_C$ as power supply voltages. Since only the gate selector 270C is enabled from timing t6, the transistors 231C and 232C use the voltages $V_C$ and $V_B$ as power supply voltages. Thus, each transistor outputs the drive signal COM-A.

Meanwhile, the voltage Out2 of the node N3 is 1/10 of the voltage Out, and thus, in order to obtain the difference voltage, both scales are aligned.

In the unit circuit 120*a* of the drive circuit (Example 2), any one of the gate selector 270A, 270B, 270C, and 270D is enabled in response to the voltage Vin of the signal ain, and thereby, an operation of causing the voltage Out2 that is obtained by dropping the voltage Out by 1/10 to follow the voltage Vin, in other words, an operation of causing the voltage Out to be amplified by 10 times the voltage Vin is performed by the pair of transistors corresponding to the gate selector which is enabled.

For example, in a case where the voltage Vin corresponds to the first range, the gate selector 270A is enabled, and thereby, the operation in which the voltage Out2 follows the voltage Vin is performed by the transistors 231A and 232A. In the same manner, in a case where the voltage Vin corresponds to the second range, the gate selector 270B is enabled, and thereby, the operation in which the voltage Out2 follows the voltage Vin is performed by the transistors 231B and 232B. In a case where the voltage Vin corresponds to the third range, the gate selector 270C is enabled, and thereby, the operation in which the voltage Out2 follows the voltage Vin is performed by the transistors 231C and 232C. In a case where the voltage Vin corresponds to the fourth range, the gate selector 270D is enabled, and thereby, the operation in which the voltage Out2 follows the voltage Vin is performed by the transistors 231D and 232D.

There is a case where the voltage Vin of the signal ain crosses (transition) adjacent regions in the first range to the fourth range. For example, referring to FIG. 14, transition of the voltage Vin from the third range to the second range is performed at timing t1. If the voltage Vin is in the third range, the gate selector 270C is enabled, and thereby, the voltage Out is controlled to be 10 times the voltage Vin by the transistors 231C and 232C. When transition of the voltage Vin from the third range to the second range is performed at the timing t1, the gate selector 270C is disabled, the gate selector 270B is enabled, and thereby, the voltage Out2 is controlled to follow the voltage Vin by the transistors 231B and 232B.

Here, a case where the transition of the voltage Vin from the third range to the second range is performed is described as an example, but other cases are the same, and for example, if transition from the second range to the first range is performed, the gate selector 270B is disabled, the gate selector 270A is enabled, and thereby, the subsequent voltage Out2 is controlled to follow the voltage Vin by the transistors 231A and 232A.

Thereby, the drive signal COM-A which is obtained by amplifying the voltage of the signal ain by 10 times is output from the nods N2 in the unit circuit 120*a*.

The four pairs of transistors are selected by the selector 280*a* in response to the signal ain, and the signals Gt1*a* and Gt2*a* are supplied to the selected pair of transistors by the gate the selectors 270A, 270B, 270C, and 270D. Accordingly, the selector 280*a* and the gate selectors 270A, 270B, and 270C are conceptualized as a first selector.

While not illustrated in particular, also in the unit circuit 120*b* of the drive circuit (Example 2) one of the four gate selectors is enabled in accordance with the voltage Vin of the signal bin, and an operation of causing the voltage Out2 that is obtained by dropping the voltage Out by 1/10 to follow the voltage Vin, in other words, an operation of causing the voltage Out to be amplified by 10 times the voltage Vin is performed by the pair of transistors corresponding to the enabled gate selector. Thereby, the unit circuit 120*b* outputs the drive signal COM-B which is obtained by amplifying the voltage of the signal bin by 10 times.

In the unit circuit 120*b* of the drive circuit (Example 2), selectors corresponding to the selector 280*a* and the gate selectors 270A, 270B, and 270C are conceptualized as a second selector.

In the unit circuit 120*a* (120*b*) of the drive circuit (Example 2), the differential amplifier 221*a* (221*b*) and the selector 223*a* (223*b*) operates by using a relatively low voltage ($V_A$–Gnd) as a power supply, and thus, it is possible to prevent a size of elements from increasing or the like.

In addition, the unit circuit 120*a* (120*b*) of the drive circuit (Example 2) includes four sets of pairs of transistors, but only one pair of transistors are turned on and the other pairs of transistors are turned off, and thus, it is possible to reduce power consumption.

A high-side transistor and a low-side transistor are continuously turned on or off in the class D amplification, and in contrast to this, according to the drive circuit (Example 1, Example 2), one of the high-side transistor and the low-side transistor performs a linear operation during a period in which the voltage of the drive signal COM-A (COM-B) is constant and the other transistor is turned off, and one of the high-side transistor and the low-side transistor performs a switching operation during a period in which the voltage of the drive signal changes and the other transistor is turned off. Accordingly, the drive circuit (Example 1, Example 2) can reduce power consumption, compared with the class D amplification.

In addition, the class D amplification requires a low pass filter (LPF) demodulating a signal which is switched by the high-side transistor and the low-side transistor, particularly, an inductor such as a coil, but the drive circuit (Example 1, Example 2) does not require the LPF. Accordingly, according to the drive circuit (Example 1, Example 2), it is possible to reduce power which is consumed in the LPF, compared with the class D amplification circuit, and to simplify and miniaturize a circuit.

However, it does not deny that the invention is applied to the class D amplification. That is, as one of the object of the invention, the spike noise is generated due to the fact that two or more of the high-side transistors and the low-side transistors are simultaneously turned on, in a unit circuit which generates a plurality of drive signals, and thus, the invention can also be applied to the class D amplification.

Hence, a drive circuit (Example 3) which performs the class D amplification will be described hereinafter.

Figure 15:
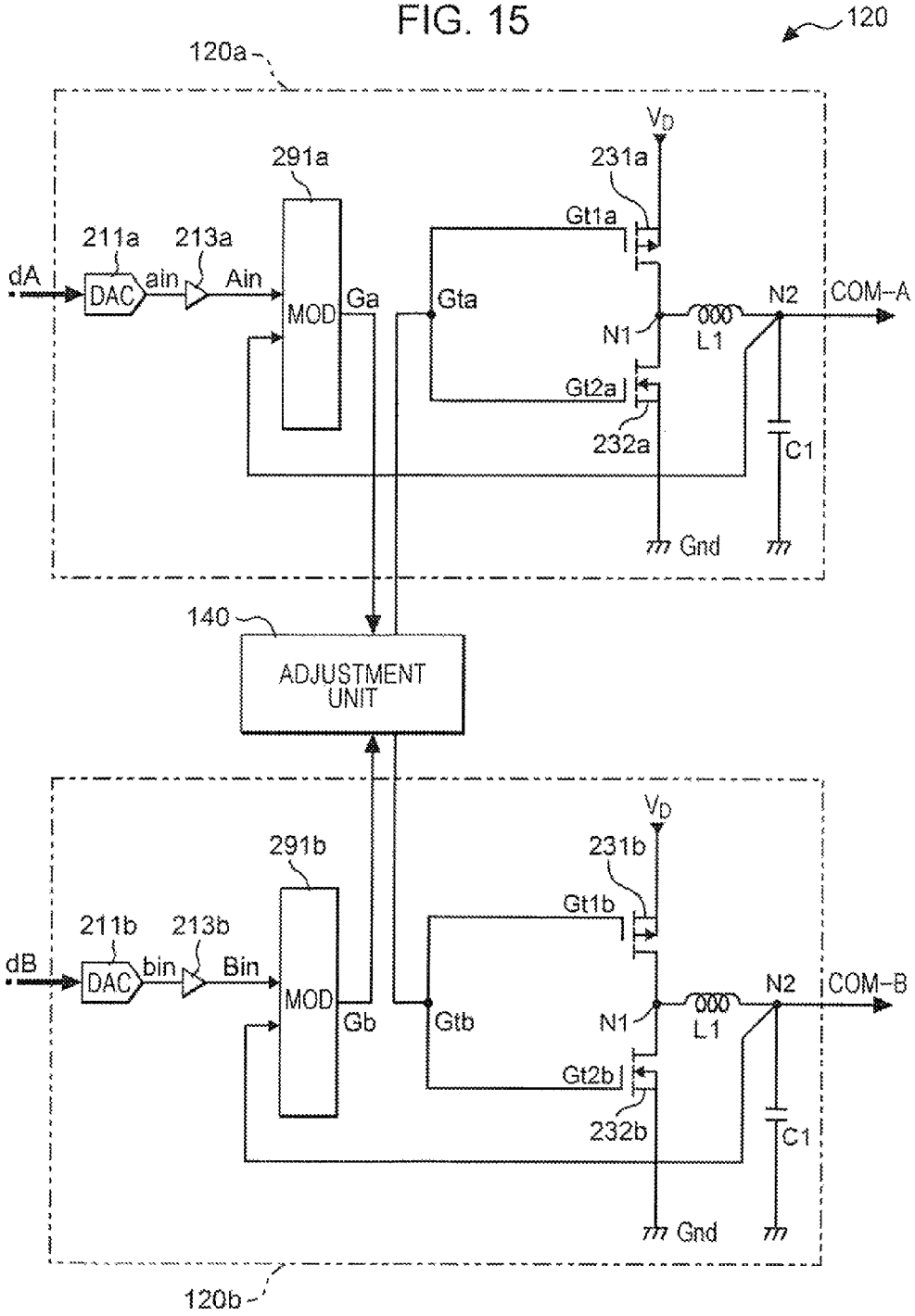
FIG. 15 is a diagram illustrating another drive circuit (Example 3) which can be applied to the printing apparatus.

FIG. 15 is a diagram illustrating the drive circuit (Example 3).

As illustrated in this figure, the drive circuit (Example 3) is common to the drive circuit (Example 1, Example 2) in that the drive circuit (Example 3) includes the unit circuits 120*a* and 120*b* and the adjustment unit 140. However, the unit circuit 120*a* of the drive circuit (Example 3) includes the DAC 211*a*, the differential amplifier 213*a*, and the transistors 231*a* and 232*a*, but is different from the drive circuit (Example 1, Example 2) in that the drive circuit (Example 3) includes a modulator (MOD) 291*a*, an inductor L1, and a capacitor C1 instead of the differential amplifier 221*a* and the selector 223*a* (refer to FIG. 10), and does not require the signals OCa and OCb.

The modulator 291*a* exclusively turns on or off the transistors 231*a* and 232*a* in response to a signal Ga which is obtained by performing a pulse width modulation of the signal Ain. A modulated signal on a node N1 is demodulated by a low pass filter (LPF) configured by the inductor L1 and the capacitor C1, is output from the node N3 as the drive signal COM-A, and is fed back to the modulator 291*a*.

In addition, the unit circuit 120*b* also has the same configuration as the unit circuit 120*a*. That is, a modulator 291*b* exclusively turns on or off transistors 231*b* and 232*b* in response to a signal Gb which is obtained by performing a pulse width modulation of the signal Bin. The modulated signal on the node N1 is demodulated by the LPF, is output from the node N2 as the drive signal COM-B, and is fed back to the modulator 291*b*.

The drive circuit (Example 3) does not use the signals OCa and OCb, and thus, the adjustment unit 140 detects only that the signals Ga and Gb simultaneously perform level changes in the same direction. If the adjustment unit 140 detects that the signals Ga and Gb simultaneously perform level changes in the same direction, the adjustment unit 140 delays the signal Gb by a predetermined time ds to return to the unit circuit 120*b* as the signal Gtb, as described above.

Thereby, the drive circuit (Example 3) can also prevent two or more of the high-side transistors and the low-side transistors in the unit circuits 120*a* and 120*b* from being simultaneously turned on, and to prevent a malfunction of the drive circuit or waveform disturbance caused by noise.

In the aforementioned drive circuit (Example 1, Example 2, Example 3), the high-side transistor is configured by a P-channel transistor and the low-side transistor is configured by an channel transistor, but both the high-side transistor and the low-side transistor may be P-channel transistors or N-channel transistors. However, an output signal of the differential amplifier 221*a* (221*b*) or the like, a gate signal at the time of being deactivated by the signals OCa and OCb, and the like need to be appropriately combined. In addition, the adjustment unit 140 also needs to determine a level change direction of the signals Ga and Gb in response to the signals OCa and OCb so as to detect simultaneous turn-on of the transistors.

In addition, in the aforementioned description, in a case where the transistors with the same in the unit circuits 120*a* and 120*b* are simultaneously turned on, the adjustment unit 140 delays only the signal Gb, but if the signal Ga is shorter than the amount of delay of the signal Gb, the signal Ga may also be delayed.

The number of unit circuits may be a number other than "2".

In the above description, the liquid ejecting apparatus is described as a printing apparatus, but the liquid ejecting apparatus may be a three-dimension shaping apparatus which ejects liquid to form a three-dimensional object, a textile printing apparatus which ejects liquid to print onto a textile, or the like.

In addition, the drive circuit 120 is provided in the main substrate 100, but may be configured to be provided in the substrate 20 (or the head unit 3) together with the drive IC 50. If the drive circuit 120 is provided in the head unit 3, it is not necessary to supply a signal with a large amplitude through the flexible flat cable 190, and thus, it is possible to improve anti-noise characteristics.

Furthermore, in the above description, an example is described in which the piezoelectric element Pzt for ejecting ink is used as a drive target or the drive circuit (Example 1, Example 2, Example 3), but when considering the drive circuit which is separated from the printing apparatus 1, the drive target is not limited to the piezoelectric element Pzt, and can be applied to all of a load with capacitive components, such as an ultrasonic motor, a touch panel, an electrostatic speaker, or a liquid crystal panel.

What is claimed is:

1. A liquid ejecting apparatus comprising:

an ejecting unit that includes a piezoelectric element which is displaced by a first drive signal or a second drive signal being applied to the piezoelectric element and ejects liquid in accordance with displacement of the piezoelectric element;

a first unit circuit that generates the first drive signal by using a first pair of transistors;

a second unit circuit that generates the second drive signal by using a second pair of transistors; and an adjustment unit, the first unit circuit providing, to the adjustment unit, a first control signal for controlling the first pair of the transistors, the second unit circuit providing, to the adjustment unit, a second control signal for controlling the second pair of the transistors, the adjustment unit delaying at least one of the first control signal and the second control signal, and supplying the first and second control signals, at least one of which has been delayed at the adjustment unit, to the first unit circuit and the second unit circuit, respectively, in a case where timing when a level of the first control signal changes and timing when a level of the second control signal changes are within a threshold time, and in a case where a predetermined condition is satisfied.

2. The liquid ejecting apparatus according to claim 1, wherein the first pair of transistors includes a first high-side transistor and a first low-side transistor, the second pair of transistors includes a second high-side transistor and a second low-side transistor, and the predetermined condition is a condition that both of the first high-side transistor and the second high-side transistor are turned on, or both of the first low-side transistor and the second low-side transistor are turned on.

3. The liquid ejecting apparatus according to claim 1, wherein the first unit circuit includes, a plurality of pairs of transistors each pair being the first pair of transistors; and a first selector that selects any one of the plurality of first pairs of transistors and supplies the first control signal which is delayed or not delayed by the adjustment unit to the selected first pair of transistors, and the second unit circuit includes, a plurality of pairs of transistors each pair being the second pair of transistors; and a second selector that selects any one of the plurality of second pairs of transistors and supplies the second control signal which is delayed or not delayed by the adjustment unit to the selected second pair of transistors.

4. The liquid ejecting apparatus according to claim 1, wherein the first control signal is output, based on a first source drive signal which is a source signal of the first drive signal, and a signal based on the first drive signal, and the second control signal is output, based on a second source drive signal which is a source signal of the second drive signal, and a signal based on the second drive signal.

5. A drive circuit which drives a capacitive load in response to any one of a first drive signal and a second drive signal, the drive circuit comprising:

a first unit circuit that generates the first drive signal by using a first pair of transistors;

a second unit circuit that generates the second drive signal by using a second pair of transistors; and an adjustment unit;

the first unit circuit providing, to the adjustment unit, a first control signal for controlling the first pair of the transistors, the second unit circuit providing, to the adjustment unit, a second control signal for controlling the second pair of the transistors, the adjustment unit delaying at least one of the first control signal and the second control signal, and supplying the first and second control signals, at least one of which has been delayed at the adjustment unit, to the first unit circuit and the second unit circuit, respectively, in a case where timing when a level of the first control signal changes and timing when a level of the second control signal changes are within a threshold time, and in a case where a predetermined condition is satisfied.

6. The liquid ejecting apparatus according to claim 1, wherein the adjustment unit delays only one of the first control signal and the second control signal when the level of the first control signal and the level of the second control signal change simultaneously, and in a case where the predetermined condition is satisfied, and the adjustment unit does not delay the first control signal and the second control signal when the level of the first control signal and the level of the second control signal do not change simultaneously.

* * * * *